United States Patent [19]

Takimoto et al.

[11] Patent Number: 4,481,928

[45] Date of Patent: Nov. 13, 1984

[54] L-JETRONIC FUEL INJECTED ENGINE CONTROL DEVICE AND METHOD SMOOTHING AIR FLOW METER OVERSHOOT

[75] Inventors: Toshiyuki Takimoto; Keiji Aoki; Shinichi Sugiyama, all of Susono, Japan

[73] Assignee: Toyota Jidosha Kabushiki Kaisha, Toyota, Japan

[21] Appl. No.: 375,219

[22] Filed: May 5, 1982

[30] Foreign Application Priority Data

Jul. 6, 1981 [JP] Japan ..... 56-105339

[51] Int. Cl.[3] ..... F02B 3/00

[52] U.S. Cl. ..... 123/492; 123/493

[58] Field of Search ..... 123/492, 493

[56] References Cited

U.S. PATENT DOCUMENTS 4,257,377 3/1981 Kinugawa ..... 123/429

4,357,923 11/1982 Hideg ..... 123/492

4,388,906 6/1983 Sugiyama ..... 123/492

*Primary Examiner*—Ronald B. Cox

*Attorney, Agent, or Firm*—Stevens, Davis, Miller & Mosher

[57] ABSTRACT

A method for controlling, according to the L-jetronic fuel injection principle, an internal combustion engine with a fuel injection valve fitted to its intake manifold, and an intake air flow meter. Repeatedly a first quantity representing the desired amount of fuel to be provided to the combustion chambers of the engine during the time period between the next two fuel injection pulse time points is determined, based upon sensed values of certain operational parameters including intake air flow, and a second quantity is determined as the time smoothed value of the first quantity. Optionally further the second quantity may be modified according to engine operational parameters. Simultaneously, at proper injection time points in the engine's operational cycle, the fuel injection valve is opened for a time corresponding to a third quantity which is calculated from the second quantity. A device is also explained, incorporating an electronic computer, which practices this method. Thereby, overshooting of the air flow meter is corrected for.

10 Claims, 11 Drawing Figures

L-JETRONIC FUEL INJECTED ENGINE CONTROL DEVICE AND METHOD SMOOTHING AIR FLOW METER OVERSHOOT

BACKGROUND OF THE INVENTION

The present invention relates to a control device and method for an internal combustion engine equipped with a fuel injection system; and more particularly relates to a control device, incorporating a plurality of sensors and an electronic control computer which receives signals from said sensors and which controls said fuel injection system of said internal combustion engine, said control device accurately and appropriately controlling the amount of fuel supplied by said fuel injection system during various and diverse operational conditions of the internal combustion engine so as to provide good engine operational characteristics, and to a control method for said internal combustion engine equipped with a fuel injection system, said control method being practiced by said device.

Fuel injection is becoming a more and more popular method of fuel supply to gasoline internal combustion engines of automotive vehicles nowadays. This is because of the inherently greater accuracy of metering of liquid fuel by fuel injection techniques as opposed to the metering of liquid fuel available in a carburetor type fuel supply system. In many cases the advantages obtained by this greater accuracy of fuel metering provided by a fuel injection system outweigh the disadvantage of the increased cost thereof. For example, this better fuel metering enables engine designers to produce engines with higher compression ratio and more spark advance, which can lead to increased performance characteristics, such as increased power, increased torque, and better engine elasticity.

Because a fuel injection system can accurately determine the amount of fuel to be supplied to the airfuel mixture intake system of the vehicle in a wide variety of engine operational conditions, it is possible to operate the engine in a way which generates substantially lower levels of harmful exhaust emissions such as NOx, HC, and CO; and in fact it is possible to satisfy the legal requirements for cleanliness of vehicle exhaust, gases, which are becoming more and more severe nowadays, without providing any exhaust gas recirculation for the engine. This is very beneficial with regard to drivability of the engine, especially in idling operational condition. Further, because of the higher efficiency of fuel metering available, this allows leaner airfuel mixture operation of the engine with still acceptable drivability. With fuel injection provided to a vehicle type, more consistent exhaust emission results are available from vehicles coming off the assembly line at the factory, without complicated, troublesome, and expensive individual adjustments. Further, the warmup control of the vehicle is highly flexible, i.e. can be flexibly adjusted to a wide variety of engine warming up conditions, which contributes considerably to the achieved exhaust emission results.

Further, an internal combustion engine equipped with a fuel injection system can be operated in such a way as to be substantially more economical of gasoline than a carburetor type internal combustion engine. This is again because of the greater accuracy available for determination of the amount of fuel to be supplied to the intake system of the vehicle over a wide variety of engine operational conditions. Since it is possible to operate the engine at the stoichiometric air/fuel ratio, and to apply closed loop control to the fuel injection control system, it is possible to reduce the amount of spark retardation, and also the above mentioned dispensing with exhaust gas recirculation is possible, and both of these have significant beneficial effects with regard to fuel consumption. Further, with a fuel injection type fuelair mixture supply system, it is possible to cut off fuel supply entirely when the engine is operating in an overrun mode, which again results in a significantly reduced consumption of fuel. Nowadays, with the increased cost of fuel and the wider demand for fuel economical vehicles, and with legal requirements which are being introduced in some countries relating to fuel economy of automotive vehicles, these considerations are more and more becoming very important. In addition, by the introduction of a fuel injection type fuel-air mixture supply system, a engine of smaller piston displacement can replace an engine with larger piston displacement which is provided with a carburetor type fuel supply system, while providing the same output power, and again this reduces fuel consumption. By the introduction of a fuel injection type fuel-air mixture supply system, also, in many cases it is possible to switch an engine from premium grade type fuel operation to operation on lower grade or regular type fuel, while still providing the same output power, which is economical of the more expensive premium grade type fuels.

Some types of fuel injection system for internal combustion engines utilize mechanical control of the amount of injected fuel. An example of this mechanical fuel amount control type of fuel injection system is the so called K-jetronic type of fuel injection system. However, nowadays, with the rapid progress which is being attained in the field of electronic control systems, various arrangements have been proposed in which electronic control circuits make control decisions as to the amount of fuel that should be supplied to the internal combustion engine, in various engine operational conditions. Such electronic fuel injection systems are becoming much more popular, because of the more flexible way in which the fuel metering can be tailored to various different combinations of engine operational conditions. The most modern of these electronic fuel injection systems use a microcomputer such as an electronic digital computer to regulate the amount of fuel injected per one engine cycle, and it is already conventionally known to use the microcomputer also to regulate various other engine functions such as the provision of ignition sparks for the spark plugs.

In an electronic fuel injection system, the control system requires of course to know the moment by moment current values of certain operational parameters of the internal combustion engine, the amount of injected fuel being determined according to these values. The current values of these operational parameters are sensed by sensors which dispatch signals to the electronic control system via A/D converters and the like. In such an arrangement, electric signals are outputted by such an electronic control system to an electrically controlled fuel injection valve, so as to open it and close it at properly determined instants separated by proper time intervals; and this fuel injection valve is provided with a substantially constant supply of pressurized gasoline from a pressure pump. This pressurized gasoline, when the fuel injection valve is opened, and during the time of such opening, is squirted through said fuel injection valve into the intake manifold of the internal combustion engine upstream of the intake valves thereof. Thus, the amount of injected gasoline is substantially proportional to the time of opening of the fuel injection valve, less, in fact, an inoperative time required for the valve to open. Sometimes only one fuel injection valve is provided for all the cylinders of the internal combustion engine, or alternatively several fuel injection valves may be provided, up to one for each cylinder of the engine, according to design requirements.

The first generation fuel injection systems were of the so called D-jetronic type, in which the main variables monitored by the electronic fuel injection control system are the revolution speed of the internal combustion engine and the vacuum, or depression, present in the intake manifold of the internal combustion engine downstream of the throttle valve mounted at an intermediate position therein due to the suction in said intake manifold produced by the air flow passing through the intake manifold of the internal combustion engine to enter the combustion chambers thereof after being mixed with liquid fuel squirted in through the fuel injection valve or valves. From these two basic measured internal combustion engine operational parameters, a basic amount of gasoline to be injected into the intake system of the internal combustion engine is determined by the control system, and then the control system controls the fuel injection valve so as to inject this amount of gasoline into the engine intake system. Other variables, such as intake air temperature, engine temperature, and others, are further measured in various implementations of the D-jetronic system and are used for performing corrections to the basic fuel injection amount.

Following this, a second generation of fuel injection systems has been developed, which is of the so called L-jetronic type, in which the main variables monitored by the electronic fuel injection control system are the revolution speed of the internal combustion engine and the amount of air flow passing through the intake manifold of the internal combustion engine to enter the combustion chambers thereof after being mixed with liquid fuel squirted in through the fuel injection valve or valves. This air flow amount is measured by an air flow meter of a design which has become developed, located at an intermediate point in the intake manifold. From these two basic measured internal combustion engine operational parameters, again a basic amount of gasoline to be injected into the intake system of the internal combustion engine is determined by the control system, and then the control system controls the fuel injection valve so as to inject this amount of gasoline into the engine intake system. Other variables, such as intake air temperature, engine temperature, and others, are again further measured in various implementations of the L-jetronic system, and are used for performing corrections to the basic fuel injection amount. This L-jetronic fuel injection control system is currently well known and is nowadays fitted to a large number and variety of vehicles.

One refinement that has been made to the L-jetronic fuel injection system has been to perform a control of the fuel injection amount based upon feedback from an air/fuel ratio sensor or O2 sensor, which is fitted to the exhaust manifold of the internal combustion engine and which detects the concentration of oxygen in these exhaust gases, again in a per se well known way. This feedback control homes in on a proper amount of fuel injection, so as to provide a stoichiometric air/fuel ratio for the intake gases sucked into the cylinders of the engine, and for the exhaust gases of the engine, but the starting point region over which the homing in action of such a feedback control system is effective is limited, and therefore the determination of the approxmately correct amount of fuel to be injected by the fuel injection valve is still very important, especially in the case of transient operational conditions of the engine.

A typical kind of air flow meter that is used in the L-jetronic system of fuel injection engine control system is illustrated in sectional view in FIG. 3 of the appended drawings. Such an air flow meter has a flapper element, biased in the rotational direction to obstruct the air intake passage, which is thus displaced in the opposite rotational direction according to the air flow amount that is being aspired into the internal combustion engine. The movement of this flapper element is sensed by some sensing system such as a potentiometer, and is damped by some damping system such as for example the one shown in the figure, which is a pneumatic type damping system.

A difficulty that has occurred with such a type of air flow meter is that such a flapper element tends to overshoot its proper position during the initial phase of sharp acceleration of the internal combustion engine, so that at this time the above mentioned air intake flow amount sensing system such as a potentiometer indicates, for a short transient time immediately after start of acceleration, a substantially greater value for intake air amount than the correct amount. It will of course be appreciated by those skilled in the art that, if the amount of fuel injected through the fuel injection valve into the intake manifold is based directly upon this erroneous signal provided by the overshooting flapper element which actuates the above mentioned air intake flow amount sensing system such as a potentiometer, then during this overshooting time, just after the start of engine acceleration, too much fuel will be supplied to the internal combustion engine, and a rich spike will be caused in the air-fuel mixture supplied to said engine. This will cause considerable variation of the acceleration being provided by the internal combustion engine, i.e. will cause jerk or torque shock during the initial phase of acceleration. Further, it has been found that merely increasing the amount of damping of the movement of the flapper element provided by said damping means such as a pneumatic damping system is not adequate to solve this problem, since over damping of the movement of said flapper element is unduly restrictive of its movement. This rich spike in the the air-fuel mixture supplied to said engine dies away quickly with time, after the initial start of acceleration.

Another difficulty that has occurred with such normal spark ignition engines which are equipped with the L-jetronic form of electronic fuel injection system is that, if the fuel injection system calculates the amount of fuel which it is desired to inject into the combustion chambers of the engine in the next pulse of fuel injection, and then simply controls the fuel injection valve or valves in the engine air intake system so as to inject this amount of fuel into the air intake system on this next fuel injection pulse, the engine will be substantially properly operated during steady operational conditions, but during the initial phase of acceleration the engine will not receive the proper amount of fuel, because of the effect of fuel adhering to the wall surfaces of the air intake passage and of the intake ports of the engine.

Considering this phenomenon in more detail, since in such a L-jetronic fuel injection system the supply of liquid fuel is not vaporized or finely atomized as in a carburetor type fuel supply system, but is squirted directly into the air intake passage of the engine through the fuel injection valve which cannot atomize the fuel very well, therefore quite a large quantity of liquid fuel tends to accumulate in liquid form on the wall surfaces of the air intake passage and of the intake ports. Of course, also some of this liquid fuel tends to get swept off or sucked off these wall surfaces into the combustion chambers of the engine. In completely steady state operation of the engine, these two effects, i.e. the fuel accumulation or adhering effect and the fuel sucking off effect, tend to cancel one another out. However, during rapidly changing operational conditions of the engine, such as sharp acceleration of the engine, these two effects by no means cancel one another out, and prior art types of fuel injection systems in which no consideration was given to the effect of adhesion of fuel on the wall surfaces of the air intake passage and of the intake ports, and the effect of sucking off of said fuel, are not able to provide proper operation of the internal combustion engine, during such sharp acceleration conditions.

In detail, in the prior art type of fuel injection system in which no consideration is given to the effect of adhesion of fuel on the wall surfaces of the air intake passage and of the intake ports, and to the effect of sucking off of said fuel, when the engine is accelerated of course the throttle valve in the air intake system is opened, and together with this the amount of fuel being injected through the fuel injection valve is simultaneously increased; but, because a substantial proportion of this extra injected fuel is adhered or accumulated in the liquid layer or film on the wall surfaces of the air intake passage and of the intake port, thus increasing the total volume of fuel in this liquid layer or film, thereby the air-fuel mixture actually being supplied into the combustion chambers of the internal combustion engine becomes over lean; in other words, a lean spike of air-fuel mixture occurs during engine acceleration, in fact somewhat after the start of such acceleration.

An aggravating factor with regard to these two problems during engine acceleration, i.e. the problem of the occurrence of an initial rich spike of air/fuel ratio caused by overshooting of the air flow meter, and the problem of the occurrence of a somewhat delayed lean spike of air/fuel ratio caused by accumulation of fuel in the liquid layer or film on the wall surfaces of the air intake passage and of the intake port, is due to the timing of these spikes. In fact, the first rich spike due to overshooting of the air flow meter tends to occur just before the second lean spike due to adherence of fuel to said wall surfaces, and the combined or synergistic effect of these two contrary spikes tends to produce a much worse jerking performance of the internal combustion engine during acceleration, than would occur because of either the rich spike or the lean spike, on its own.

This effect is illustrated in FIGS. 8 and 9 of the appended drawings. FIG. 8 is a time chart, in which air/fuel ratio of air-fuel mixture actually delivered to the combustion chambers of the internal combustion engine is shown on the ordinate and time is shown on the abscissa, showing by the single dotted line the behavior of variation of air/fuel ratio of the air-fuel mixture of an engine with a fuel injection system controlled according to a prior art method of engine control, during an engine operational episode involving sharp acceleration. This figure illustrates that during steady operation of the internal combustion engine the air/fuel ratio of the air-fuel mixture in this engine controlled in a prior art fashion is substantially stoichiometric, but that during sharp acceleration of the engine the air/fuel ratio of the air-fuel mixture in this engine controlled in such a prior art fashion deviates substantially from stoichiometric first towards the rich side and then immediately subsequently towards the lean side, i.e. undergoes in rapid succession first a rich spike and then a lean spike. Further, FIG. 9 is a time chart, in which vehicle acceleration is shown on the ordinate and time is shown on the abscissa, said abscissa corresponding to and indicating the same time as the abscissa of FIG. 8, showing by the dashed line the behavior of variation of vehicle acceleration of said vehicle incorporating said internal combustion engine with a fuel injection system controlled according to said prior art method of engine control, during the same sharp acceleration engine operational episode as the engine operational episode illustrated in FIG. 8. This figure shows that when this vehicle incorporating this internal combustion engine with a fuel injection system controlled according to said prior art method is sharply accelerated, it undergoes very sharp variation of acceleration, i.e. jerk or lurching, which is very uncomfortable for riders in the vehicle, and reduces vehicle drivability, as well as impairing durability of the engine and of the transmission of the vehicle, which transmits the power of said engine to the road surface. Further, the presence of the above described rich spike and of the above described lean spike of air/fuel ratio of the air-fuel mixture supplied to the combustion chambers of the internal combustion engine are liable to cause problems with regard to meeting the ever more strict standards with regard to purification of the exhaust gases of the internal combustion engine.

In order to investigate the problems with regard to the amount of fuel adhering to the wall surfaces of the intake manifold and the intake ports, one of the present inventors, together with another, has carried out various experimental researches relative to the behavior of fuel, both in its adhering to said wall surfaces of the air intake passage and of the intake ports, and in its being sucked off from said wall surfaces by the air flowing therepast, so as to enter into the combustion chambers of the engine. Some of the results of these experimental researches may be summarized as follows. The amount of fuel out of one pulse of fuel injection provided through the fuel injection valve which adheres to the wall surfaces of the air intake passage and of the intake ports, so as to be added to the cumulative amount of fuel already there, is, other things being equal, roughly proportional to the total amount of fuel in said fuel injection pulse; in other words, substantially the same proportion of the injected fuel tends to adhere to said wall surfaces, irrespective of the actual amount of injected fuel. The proportionality constant relative to this adhesion, however, tends to vary with variation of, in particular, the following quantities: air intake manifold pressure or depression, engine cooling water temperature, engine revolution speed, and air flow speed in the air intake manifold. As a matter of fact, said proportionality constant varies, to a lesser extent, with intake passage wall temperature and intake air temperature and atmospheric pressure. Further, the absolute amount of fuel out of the total or cumulative amount of fuel which is adhering to the wall surfaces of the air intake passage and of the intake ports which is sucked off into the combustion chambers of the internal combustion engine is, other things being equal, roughly proportional to said total or cumulative amount of fuel adhering to the wall surfaces of the air intake passage and of the intake ports; in other words, substantially the same proportion of the fuel adhering to the wall surfaces tends to be sucked off, irrespective of the actual amount of adhering fuel. The proportionality constant relative to this sucking off, however, again tends to vary with variation of the following quantities: air intake manifold pressure or depression, engine cooling water temperature, engine revolution speed, and air flow speed in the air intake manifold. Again, as a matter of fact, said proportionality constant varies, to a lesser extent, with intake passage wall temperature and intake air temperature and atmospheric pressure. Further details of these experimental researches performed by the present inventor, and another, with respect to these proportionality constants will be found later in the section of this specification entitled "DESCRIPTION OF THE PREFERRED EMBODIMENT".

SUMMARY OF THE INVENTION

Accordingly, it is the primary object of the present invention to provide a method for controlling an internal combustion engine which is equipped with an electronic fuel injection system, and a device which implements the method, which take account of this overshooting of the air flow meter during sharp acceleration of the engine.

It is a further object of the present invention to provide such a method for controlling an internal combustion engine which is equipped with an electronic fuel injection system, and a device which implements the method, which avoid fluctuations in the air/fuel ratio of the air-fuel mixture being supplied to the combustion chambers of the engine, due to this overshooting of the air flow meter during sharp acceleration of the engine.

It is a further object of the present invention to provide such a method for controlling an internal combustion engine which is equipped with an electronic fuel injection system, and a device which implements the method, which during the initial phase of acceleration of the internal combustion engine when the air flow meter is overshooting can compensate for this increase so as to avoid a rich spike being produced in the air/fuel ratio of the air-fuel mixture delivered to the internal combustion engine.

It is a further object of the present invention to provide such a method for controlling an internal combustion engine which is equipped with an electronic fuel injection system, and a device which implements the method, which do not require the provision of any very complicated means for determining the air intake amount of the internal combustion engine, but which use the common or conventional form of air flow meter for this purpose, while avoiding the problems detailed above with respect to overshooting thereof.

It is a further object of the present invention to provide such a method for controlling an internal combustion engine which is equipped with an electronic fuel injection system, and a device which implements the method, which can provide an air-fuel mixture of the proper air/fuel ratio, both during steady operation of the internal combustion engine, and during transient operational conditions thereof such as acceleration.

It is a further object of the present invention to provide such a method for controlling an internal combustion engine which is equipped with an electronic fuel injection system, and a device which implements the method, which can also properly take account of the quantity of fuel which is present in said liquid layer or film on the wall surfaces of the air intake passage and of the intake ports.

It is a further object of the present invention to provide such a method for controlling an internal combustion engine which is equipped with an electronic fuel injection system, and a device which implements the method, which can also perform a correction to somewhat increase the basic fuel injection amount provided by the fuel injection system, during the phase of acceleration of the internal combustion engine when the amount of fuel which is adhered in a film to the wall surfaces of the air intake passage and of the intake ports is increasing, said phase of acceleration occurring just after the phase of acceleration in which said overshooting of said intake air flow meter is liable to occur, so as to also compensate for this increase and so as to avoid a lean spike being produced in the air/fuel ratio of the air-fuel mixture delivered to the internal combustion engine during this accelerational phase.

It is a further object of the present invention to provide such a method for controlling an internal combustion engine which is equipped with an electronic fuel injection system, and a device which implements the method, which during acceleration of the internal combustion engine can avoid the successive production, in the air/fuel ratio of the air-fuel mixture delivered to the internal combustion engine, of a rich spike followed by a lean spike.

It is yet a further object of the present invention to provide such a method for controlling an internal combustion engine which is equipped with an electronic fuel injection system, and a device which implements the method, which provide good drivability for an automotive vehicle incorporating the fuel injection system, especially during acceleration thereof.

It is yet a further object of the present invention to provide such a method for controlling an internal combustion engine which is equipped with an electronic fuel injection system, and a device which implements the method, which avoid the production of excessive jerking or acceleration variation during acceleration of an automotive vehicle incorporating the fuel injection system.

It is yet a further object of the present invention to provide such a method for controlling an internal combustion engine which is equipped with an electronic fuel injection system, and a device which implements the method, which ensure good quality of exhaust emissions for an automotive vehicle incorporating the fuel injection system, especially during acceleration thereof.

Of course, the provision of any special sensor for detecting the actual amount of adhered fuel on the wall surfaces of the air intake passage and of the intake ports is not practicable: such a sensor, even if it could be made, would be costly, difficult to make and install and service, and prone to breakdown during use.

Therefore, it is yet a further object of the present invention to provide such a method for controlling an internal combustion engine which is equipped with an electronic fuel injection system, and a device which implements the method, which do not require any special sensor for detecting the actual amount of adhered fuel on the wall surfaces of the air intake passage and of the intake ports.

It is yet a further object of the present invention to provide such a method for controlling an internal combustion engine which is equipped with an electronic fuel injection system, and a device which implements the method, which are not prone to breakdown during use.

It is yet a further object of the present invention to provide such a method for controlling an internal combustion engine which is equipped with an electronic fuel injection system, and a device which implements the method, which do not involve undue expense in manufacture of the fuel injection system.

It is yet a further object of the present invention to provide such a method for controlling an internal combustion engine which is equipped with an electronic fuel injection system, and a device which implements the method, which do not involve undue difficulty in manufacture of the fuel injection system.

It is yet a further object of the present invention to provide such a method for controlling an internal combustion engine which is equipped with an electronic fuel injection system, and a device which implements the method, which do not involve undue difficulty in maintenance of the fuel injection system.

According to the most general method aspect of the present invention, these and other objects are accomplished by, for an internal combustion engine with a combustion chamber system and comprising an air-fuel mixture intake system comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control method, comprising the processes, repeatedly and alternatingly and/or simultaneously performed, of: (a) sensing the current values of certain operational parameters of said internal combustion engine, including sensing the value of the rate of flow of intake air into said intake manifold by the use of an intake air flow meter; (b) performing the following processes in the specified order: (b1) based upon the current values of said sensed operational parameters of said internal combustion engine, including the current value of rate of flow of intake air into said intake manifold, calculating the value of a first quantity representing the desired amount of fuel to be provided to said combustion chamber system of said internal combustion engine during the time period between the next two fuel injection pulse time points; (b2) updating the value of a second quantity representing the time smoothed desired amount of fuel to be provided to said combustion chamber system of said internal combustion engine during the time period between the next two fuel injection pulse time points, by adding to said second quantity representing the time smoothed desired amount of fuel to be provided to said combustion chamber system of said internal combustion engine during the time period between the next two fuel injection pulse time points the value produced by subtracting said second quantity representing the time smoothed desired amount of fuel to be provided to said combustion chamber system of said internal combustion engine during the time period between the next two fuel injection pulse time points from said first quantity representing the desired amount of fuel to be provided to said combustion chamber system of said internal combustion engine during the time period between the next two fuel injection pulse time points and multiplying the result by a constant value less than unity; and (b3) optionally further modifying said second quantity representing the time smoothed desired amount of fuel to be provided to said combustion chamber system of said internal combustion engine during the time period between the next two fuel injection pulse time points according to engine operational parameters; and (c) at time points in said operational cycle of said internal combustion engine and said fuel injection valve which are proper fuel injection time points, performing the following processes in the specified order: (c1) modifying said actuating signal according to the value of a third quantity representing the actual corrected fuel amount to be injected through said fuel injection valve in the next fuel injection pulse, said third quantity representing the actual corrected fuel amount to be injected through said fuel injection valve in the next fuel injection pulse being calculated from the current value of said second quantity representing the time smoothed desired amount of fuel to be provided to said combustion chamber system of said internal combustion engine during the time period between the next two fuel injection pulse time points; and (c2) supplying said modified actuating signal to said fuel injection valve in such a fashion as to cause said fuel injection valve to open for a time period which will allow an amount of fuel approximately equal to the fuel amount represented by said third quantity representing the actual corrected fuel amount to be injected through said fuel injection valve in the next fuel injection pulse to pass through said fuel injection valve so as to be injected into said intake manifold.

According to such a method, by time smoothing the value of said first quantity representing the desired amount of fuel to be provided to said combustion chamber system of said internal combustion engine during the time period between the next two fuel injection pulse time points in the way outlined to produce said second quantity representing the time smoothed desired amount of fuel to be provided to said combustion chamber system of said internal combustion engine during the time period between the next two fuel injection pulse time points, whose value thus pursues the value of said first quantity representing the desired amount of fuel to be provided to said combustion chamber system of said internal combustion engine during the time period between the next two fuel injection pulse time points, thereby fluctuations in the output signal of said intake air flow meter, due to overshooting thereof during acceleration, can be taken account of; and thereby occurrence of the aforementioned undesirable initial rich spike during engine acceleration is effectively prevented.

Further, according to a more restricted method aspect of the present invention, these and other objects are more particularly and concretely accomplished by, for an internal combustion engine with a combustion chamber system and comprising an air-fuel mixture intake system comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control method, comprising the processes, repeatedly and alternatingly and/or simultaneously performed, of: (a) sensing the current values of certain operational parameters of said internal combustion engine, including sensing the value of the rate of flow of intake air into said intake manifold by the use of an intake air flow meter; (b) performing the following processes in the specified order: (b1) based upon the current values of said sensed operational parameters of said internal combustion engine, including the current value of rate of flow of intake air into said intake manifold, calculating the value of a first quantity representing the desired amount of fuel to be provided to said combustion chamber system of said internal combustion engine during the time period between the next two fuel injection pulse time points; (b2) updating the value of a second quantity representing the time smoothed desired amount of fuel to be provided to said combustion chamber system of said internal combustion engine during the time period between the next two fuel injection pulse time points, by adding to said second quantity representing the time smoothed desired amount of fuel to be provided to said combustion chamber system of said internal combustion engine during the time period between the next two fuel injection pulse time points the value produced by subtracting said second quantity representing the time smoothed desired amount of fuel to be provided to said combustion chamber system of said internal combustion engine during the time period between the next two fuel injection pulse time points from said first quantity representing the desired amount of fuel to be provided to said combustion chamber system of said internal combustion engine during the time period between the next two fuel injection pulse time points and multiplying the result by a constant value less than unity; and (b3) optionally further modifying said second quantity representing the time smoothed desired amount of fuel to be provided to said combustion chamber system of said internal combustion engine during the time period between the next two fuel injection pulse time points according to engine operational parameters; and (c) at time points in said operational cycle of said internal combustion engine and said fuel injection valve which are proper fuel injection time points, if according to the current operational conditions of said internal combustion engine it is currently proper to inject fuel through said fuel injection valve, performing the following processes in the specified order: (c1) modifying said actuating signal according to the value of a third quantity representing the actual corrected fuel amount to be injected through said fuel injection valve in the next fuel injection pulse, said third quantity representing the actual corrected fuel amount to be injected through said fuel injection valve in the next fuel injection pulse being calculated from the current value of said second quantity representing the time smoothed desired amount of fuel to be provided to said combustion chamber system of said internal combustion engine during the time period between the next two fuel injection pulse time points; and (c2) supplying said modified actuating signal to said fuel injection valve in such a fashion as to cause said fuel injection valve to open for a time period which will allow an amount of fuel approximately equal to the fuel amount represented by said third quality representing the actual corrected fuel amount to be injected through said fuel injection valve in the next fuel injection pulse to pass through said fuel injection valve so as to be injected into said intake manifold.

According to such a method, by time smoothing tthe value of said first quantity representing the desired amount of fuel to be provided to said combustion chamber system of said internal combustion engine during the time period between the next two fuel injection pulse time points in the way outlined to produce said second quantity representing the time smoothed desired amount of fuel to be provided to said combustion chamber system of said internal combustion engine during the time period between the next two fuel injection pulse time points, whose value thus pursues the value of said first quantity representing the desired amount of fuel to be provided to said combustion chamber system of said internal combustion engine during the time period between the next two fuel injection pulse time points, both during the operational conditions when fuel injection is being performed into said air-fuel mixture intake system, and also during the operational conditions when fuel injection into said air-fuel mixture intake system is being cut off, thereby fluctuations in the output signal of said intake air flow meter, due to overshooting thereof during acceleration, can be taken account of. Thus, the amount of fuel actually injected into said air-fuel mixture intake system through said fuel injection valve is adjusted, so as to ensure that approximately the correct amount of fuel actually reaches the combustion chamber system of the internal combustion engine, both during the operational conditions when fuel injection is being performed into said air-fuel mixture intake system, and also during the operational conditions when fuel injection into said air-fuel mixture intake system is being cut off. Thus, occurrence of the aforementioned undesirable initial rich spike during engine acceleration is again effectively prevented.

Further, according to a more particular method aspect of the present invention, these and other objects are more particularly and concretely accomplished by an engine control method of either one of the kinds described above, wherein said constant value is less than about 0.1, and more particularly wherein said constant value is about 0.025.

According to such a method, the characteristic time period, over which this time smoothing of said first quantity representing the desired amount of fuel to be provided to said combustion chamber system of said internal combustion engine during the time period between the next two fuel injection pulse time points is performed, is more than about ten times the time period taken to perform the actions detailed in step (b); and more particularly may be about forty times this time period.

Further, according to a more restricted method aspect of the present invention, these and other objects are more particularly and concretely accomplished by, for an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control method, comprising the processes, repeatedly and alternatingly and/or simultaneously performed, of: (a) sensing the current values of certain operational parameters of said internal combustion engine, including sensing the value of the rate of flow of intake air into said intake manifold by the use of an intake air flow meter; (b) performing the following processes in the specified order: (b1) based upon the current values of said sensed operational parameters of said internal combustion engine, including the current value of the rate of flow of intake air into said intake manifold, calculating the value of a first quantity representing the desired amount of fuel to be provided to said combustion chamber system of said internal combustion engine during the time period between the next two fuel injection pulse time points; (b2) updating the value of a second quantity representing the time smoothed desired amount of fuel to be provided to said combustion chamber system of said internal combustion engine during the time period between the next two fuel injection pulse time points, by adding to said second quantity representing the time smoothed desired amount of fuel to be provided to said combustion chamber system of said internal combustion engine during the time period between the next two fuel injection pulse time points the value produced by subtracting said second quantity representing the time smoothed desired amount of fuel to be provided to said combustion chamber system of said internal combustion engine during the time period between the next two fuel injection pulse time points from said first quantity representing the desired amount of fuel to be provided to said combustion chamber system of said internal combustion engine during the time period between the next two fuel injection pulse time points and multiplying the result by a constant value less than unity; and (b3) optionally further modifying said second quantity representing the time smoothed desired amount of fuel to be provided to said combustion chamber system of said internal combustion engine during the time period between the next two fuel injection pulse time points according to engine operational parameters; (c) calculating the value of a third quantity representing the proportion of fuel in one pulse of fuel injected through said fuel injection valve which will adhere to said walls of said air-fuel mixture intake system, and the value of a fourth quantity representing the proportion of the total amount of fuel adhering to said walls of said air-fuel mixture intake system which is sucked off therefrom to pass into said combustion chamber system of said internal combustion engine during the time interval between two successive fuel injection pulses; and (d) at time points in said operational cycle of said internal combustion engine and said fuel injection valve which are proper fuel injection time points, performing the following processes in the specified order: (d1) calculating, from the current value of a fifth quantity representing the total amount of fuel adhering to said walls of said air-fuel mixture intake system, and the current value of said fourth quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; (d2) calculating, from the current value of said second quantity representing the time smoothed desired amount of fuel to be provided to said combustion chamber system of said internal combustion engine during the time period between the next two fuel injection pulse time points, from the current value of said third quantity representing the proportion of fuel in one pulse of fuel injected through said fuel injection valve which will adhere to said walls of said air-fuel mixture intake system, and from the current value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it, the value of a seventh quantity representing the actual fuel amount to be injected through said fuel injection valve in the next fuel injection pulse; (d3) calculating, from the current value of said seventh quantity representing the actual fuel amount to be injected through said fuel injection valve in the next fuel injection pulse and the current value of said third quantity representing the proportion of fuel in one pulse of fuel injected through said fuel injection valve which will adhere to said walls of said air-fuel mixture intake system, the value of an eighth quantity representing the amount of fuel from the next fuel injection pulse that will adhere to said walls of said air-fuel mixture intake system; (d4) updating the value of said fifth quantity representing the total amount of fuel adhering to said walls of said air-fuel mixture intake system by adding thereto the value of said eighth quantity representing the amount of fuel from the next fuel injection pulse that will adhere to said walls of said air-fuel mixture intake system and by subtracting from the result of this addition the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; (d5) modifying said actuating signal according to the value of said seventh quantity representing the actual fuel amount to be injected through said fuel injection valve in the next fuel injection pulse; and (d6) supplying said modified actuating signal to said fuel injection valve in such a fashion as to cause said fuel injection valve to open for a time period which will allow an amount of fuel approximately equal to the fuel amount represented by said seventh quantity representing the acutal fuel amount to be injected through said fuel injection valve in the next fuel injection pulse to pass through said fuel injection valve so as to be injected into said intake manifold; wherein the method used in subprocess (d2) for calculating the value of said seventh quantity representing the actual fuel amount to be injected through said fuel injection valve in the next fuel injection pulse is such that the sum of the value of said seventh quantity representing the actual fuel amount to be injected through said fuel injection valve in the next fuel injection pulse and the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it less the value of said eighth quantity representing the amount of fuel from the next fuel injection pulse that will adhere to said walls of said air-fuel mixture intake system is approximately equal to the value of said second quantity representing the time smoothed desired amount of fuel to be provided to said combustion chamber system of said internal combustion engine during the time period between the next two fuel injection pulse time points.

According to such a method, account is also kept of the total amount of fuel adhering to the wall surfaces of the air-fuel mixture intake system, by also performing the calculations detailed above; and according thereto the amount of fuel actually injected into said air-fuel mixture intake system through said fuel injection valve is adjusted, so as to ensure that approximately the correct amount of fuel actually reaches the combustion chamber system of the internal combustion engine. Thus, occurrence of the aforementioned undesirable later following lean spike during engine acceleration is also effectively prevented.

Further, according to a more restricted method aspect of the present invention, these and other objects are more particularly and concretely accomplished by, for an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control method, comprising the processes, repeatedly and alternatingly and/or simultaneously performed, of: (a) sensing the current values of certain operational parameters of said internal combustion engine, including sensing the value of the rate of flow of intake air into said intake manifold by the use of an intake air flow meter; (b) performing the following processes in the specified order: (b1) based upon the current values of said sensed operational parameters of said internal combustion engine, including the current value of the rate of flow of intake air into said intake manifold, calculating the value of a first quantity representing the desired amount of fuel to be provided to said combustion chamber system of said internal combustion engine during the time period between the next two fuel injection pulse time points; (b2) updating the value of a second quantity representing the time smoothed desired amount of fuel to be provided to said combustion chamber system of said internal combustion engine during the time period between the next two fuel injection pulse time points, by adding to said second quantity representing the time smoothed desired amount of fuel to be provided to said combustion chamber system of said internal combustion engine during the time period between the next two fuel injection pulse time points the value produced by subtracting said second quantity representing the time smoothed desired amount of fuel to be provided to said combustion chamber system of said internal combustion engine during the time period between the next two fuel injection pulse time points from said first quantity representing the desired amount of fuel to be provided to said combustion chamber system of said internal combustion engine during the time period between the next two fuel injection pulse time points and multiplying the result by a constant value less than unity; and (b3) optionally further modifying said second quantity representing the time smoothed desired amount of fuel to be provided to said combustion chamber system of said internal combustion engine during the time period between the next two fuel injection pulse time points according to engine operational parameters; (c) calculating the value of a third quantity representing the proportion of fuel in one pulse of fuel injected through said fuel injection valve which will adhere to said walls of said air-fuel mixture intake system, and the value of a fourth quantity representing the proportion of the total amount of fuel adhering to said walls of said air-fuel mixture intake system which is sucked off therefrom to pass into said combustion chamber system of said internal combustion engine during the time interval between two successive fuel injection pulses; and (d) at time points in said operational cycle of said internal combustion engine and said fuel injection valve which are proper fuel injection time points, performing the following processes in the specified order; (d1) calculating, from the current value of a fifth quantity representing the total amount of fuel adhering to said walls of said air-fuel mixture intake system, and the current value of said fourth quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; and then, if according to the current operational conditions of said internal combustion engine it is proper to inject fuel through said fuel injection valve, (d2) performing the following processes in the specified order: (d2.1) calculating, from the current value of said second quantity representing the time smoothed desired amount of fuel to be provided to said combustion chamber system of said internal combustion engine during the time period between the next two fuel injection pulse time points, from the current value of said third quantity representing the proportion of fuel in one pulse of fuel injected through said fuel injection valve which will adhere to said walls of said air-fuel mixture intake system, and from the current value of said sixth quantity representing the amount of fuel from the total amount of fuel adhering to said walls of said air-fuel mixture intake system which will be sucked off therefrom to pass into said combustion chamber system to said internal combustion engine in the time interval between the next fuel injection pulse time instant and the next fuel injection pulse time instant after it, the value of a seventh quantity representing the actual fuel amount to be injected through said fuel injection valve in the next fuel injection pulse; (d2.2) calculating, from the current value of said seventh quantity representing the actual fuel amount to be injected through said fuel injection valve in next fuel injection pulse and the current value of said third quantity representing the proportion of fuel in one pulse of fuel injected through said fuel injection valve which will adhere to said walls of said air-fuel mixture intake system, the value of an eighth quantity representing the amount of fuel from the next fuel injection pulse that will adhere to said walls of said air-fuel mixture intake system; (d2.3) updating the value of said fifth quantity representing the total amount of fuel adhering to said walls of said air-fuel mixture intake system by adding thereto the value of said eighth quantity representing the amount of fuel from the next fuel injection pulse that will adhere to said walls of said air-fuel mixture intake system and by subtracting from the result of this addition the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; (d2.4) modifying said actuating signal according to the value of said seventh quantity representing the actual feed amount to be injected through said fuel injection valve in the next fuel injection pulse; and (d2.5) supplying said modified actuating signal to said fuel injection valve in such a fashion as to cause said fuel injection valve to open for a time period which will allow an amount of fuel approximately equal to the fuel amount represented by said seventh quantity representing the actual fuel amount to be injected through said fuel injection valve in the next fuel injection pulse to pass through said fuel injection valve so as to be injected into said intake manifold; but otherwise, if according to the current operational conditions of said internal combustion engine it is not proper to inject fuel through said fuel injection valve, then (d3) performing the following process: (d3.1) updating the value of said fifth quantity representing the total amount of fuel adhering to said walls of said air-fuel mixture intake system by subtracting therefrom the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; wherein the method used in subprocess (d2.1) for calculating the value of said seventh quantity representing the actual fuel amount to be injected through said fuel injection valve in the next fuel injection pulse is such that the sum of the value of said seventh quantity representing the actual fuel amount to be injected through said fuel injection valve in the next fuel injection pulse and the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it less the value of said eighth quantity representing the amount of fuel from the next fuel injection pulse that will adhere to said walls of said air-fuel mixture intake system is approximately equal to the value of said second quantity representing the time smoothed desired amount of fuel to be provided to said combustion chamber system of said internal combustion engine during the time period between the next two fuel injection pulse time points.

According to such a method, account is also kept of the total amount of fuel adhering to the wall surfaces of the air-fuel mixture intake system, by also performing the calculations detailed above, both during the operational conditions when fuel injection is being performed into said air-fuel mixture intake system, and also during the operational conditions when fuel injection into said air-fuel mixture intake system is being cut off; and according thereto the amount of fuel actually injected into said air-fuel mixture intake system through said fuel injection valve is adjusted, so as to ensure that approximately the correct amount of fuel actually reaches the combustion chamber system of the internal combustion engine, both during the operational conditions when fuel injection is being performed into said air-fuel mixture intake system, and also during the operational conditions when fuel injection into said air-fuel mixture intake system is being cut off. Thus, occurrence of the aforementioned later following undesirable lean spike during engine acceleration is also effectively prevented, and good fuel economy of the internal combustion engine is available.

Further, according to a more particular method aspect of the present invention, these and other objects are more particularly and concretely accomplished by an engine control method of any single one of the last two kinds described above, wherein the method used for calculating the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it is to multiply the value of said fifth quantity representing the total amount of fuel adhering to said walls of said air-fuel mixture intake system by the value of said fourth quantity representing the proportion of the total amount of fuel adhering to said walls of said air-fuel mixture intake system which is sucked off therefrom to pass into said combustion chamber system of said internal combustion engine during the time interval between two successive fuel injection pulses.

According to such a method, said sixth quantity representing the amount of fuel from the total amount of fuel adhering to said walls of said air-fuel mixture intake system which will be sucked off therefrom is calculated simply and yet effectively. It has been shown, by the aforementioned process of experiment, that this method of calculation is adequate for predicting the value of the sucked off amount of fuel.

Further, according to another more particular method aspect of the present invention, these and other objects are more particularly and concretely accomplished by an engine control method of any single one of the last three kinds described above, wherein the method used for calculating the value of said seventh quantity representing the actual fuel amount to be injected through said fuel injection valve in the next fuel injection pulse is to subtract from the value of said second quantity representing the time smoothed desired amount of fuel to be provided to said combustion chamber system of said internal combustion engine during the time period between the next two fuel injection pulse time points the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it, and to divide the result by unity less the value of said third quantity representing the proportion of fuel in one pulse of fuel injected through said fuel injection valve which will adhere to said walls of said air-fuel mixture intake system.

According to such a method, said seventh quantity representing the actual fuel amount to be injected through said fuel injection valve in the next fuel injection pulse is calculated simply and yet effectively, by a formula which will be explained in detail in the portion of this specification entitled "DESCRIPTION OF THE PREFERRED EMBODIMENT". It has been shown, by the aforementioned process of experiment, that this method of calculation is adequate for predicting the value of the sucked off amount of fuel.

Further, according to yet another more particular method aspect of the present invention, these and other objects are more particularly and concretely accomplished by an engine control method of any single one of the last four kinds described above, wherein the method used for calculating the value of said eighth quantity representing the amount of fuel from the next fuel injection pulse that will adhere to said walls of said air-fuel mixture intake system is to multiply the value of said seventh quantity representing the actual fuel amount to be injected through said fuel injection valve in the next fuel injection pulse by the value of said third quantity representing the proportion of fuel in one pulse of fuel injection through said fuel injection valve which will adhere to said walls of said air-fuel mixture intake system.

According to such a method, said eighth quantity representing the amount of fuel from the next fuel injection pulse that will adhere to said walls of said air-fuel mixture intake system is calculated simply and yet effectively. It has been shown, by the aforementioned process of experiment, that this method of calculation is adequate for predicting the value of the sucked off amount of fuel.

Further, according to the most general device aspect of the present invention, these and other objects are accomplished by, for an internal combustion engine with a combustion chamber system and comprising an air-fuel mixture intake system comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control device, comprising: (a) a plurality of sensors which sense the current values of certain operational parameters of said internal combustion engine, including an intake air flow meter which senses the current value of rate of flow of intake air into said intake manifold; (b) an interface device, which, whenever it receives a fuel injection valve control electrical signal, dispatches said fuel injection valve actuating signal to said fuel injection valve; and (c) an electronic computer, which receives supply of signals from said sensors indicative of said current values of said certain operational parameters of said internal combustion engine, including a signal from said intake air flow meter indicative of the current value of rate of flow of intake air into said intake manifold; (d) said electronic computer repeatedly and alternatingly and/or simultaneously: (d1) performing the following process in the specified order: (d1.1) based upon the current values of said sensed operational parameters of said internal combustion engine, including the current value of rate of flow of intake air into said intake manifold, calculating the value of a first quantity representing the desired amount of fuel to be provided to said combustion chamber system of said internal combustion engine during the time period between the next two fuel injection pulse time points; (d1.2) updating the value of a second quantity representing the time smoothed desired amount of fuel to be provided to said combustion chamber system of said internal combustion engine during the time period between the next two fuel injection pulse time points, by adding to said second quantity representing the time smoothed desired amount of fuel to be provided to said combustion chamber system of said internal combustion engine during the time period between the next two fuel injection pulse time points the value produced by subtracting said second quantity representing the time smoothed desired amount of fuel to be provided to said combustion chamber system of said internal combustion engine during the time period between the next two fuel injection pulse time points from said first quantity representing the desired amount of fuel to be provided to said combustion chamber system of said internal combustion engine during the time period between the next two fuel injection pulse time points and multiplying the result by a constant value less than unity; and (d1.3) optionally further modifying said second quantity representing the time smoothed desired amount of fuel to be provided to said combustion chamber system of said internal combustion engine during the time period between the next two fuel injection pulse time points according to engine operational parameters; and (d2) at time points in said operational cycle of said internal combustion engine and said fuel injection valve which are proper fuel injection time points, performing the following processes in the specified order: (d2.1) calculating, from the current value of said second quantity representing the time smoothed desired amount of fuel to be provided to said combustion chamber system of said internal combustion engine during the time period between the next two fuel injection pulse time points, the value of a third quantity representing the actual fuel amount to be injected through said fuel injection valve in the next fuel injection pulse; and (d2.2) outputting to said interface device a fuel injection valve control electrical signal, based upon the value of said third quantity representing the actual fuel amount to be injected through said fuel injection valve in the next fuel injection pulse, such as to cause said fuel injection valve to open for a time period which will allow an amount of fuel approximately equal to the fuel amount represented by said third quantity representing the actual fuel amount to be injected through said fuel injection valve in the next fuel injection pulse to pass through said fuel injection valve so as to be injected into said intake manifold.

According to such a structure, by said electronic computer thus time smoothing the value of said first quantity representing the desired amount of fuel to be provided to said combustion chamber system of said internal combustion engine during the time period between the next two fuel injection pulse time points in the way outlined to produce said second quantity representing the time smoothed desired amount of fuel to be provided to said combustion chamber system of said internal combustion engine during the time period between the next two fuel injection pulse time points, whose value thus pursues the value of said first quantity representing the desired amount of fuel to be provided to said combustion chamber system of said internal combustion engine during the time period between the next two fuel injection pulse time points, thereby fluctuations in the output signal of said intake air flow meter, due to overshooting thereof during acceleration, can be taken account of; and thereby occurrence of the aforementioned undesirable initial rich spike during engine acceleration is effectively prevented.

Further, according to a more restricted device aspect of the present invention, these and other objects are more particularly and concretely accomplished by, for an internal combustion engine with a combustion chamber system and comprising an air-fuel mixture intake system comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control device, comprising: (a) a plurality of sensors which sense the current values of certain operational parameters of said internal combustion engine, including an intake air flow meter which senses the current value of rate of flow of intake air into said intake manifold; (b) an interface device, which, whenever it receives a fuel injection valve control electrical signal, dispatches said fuel injection valve actuating signal to said fuel injection valve; and (c) an electonic computer, which receives supply of signals from said sensors indicative of said current values of said certain operational parameters of said internal combustion engine, including a signal from said intake air meter indicative of the current value of rate of flow of intake air into said intake manifold; (d) said electronic computer repeatedly and alternatingly and/or simultaneously: (d1) performing the following processes in the specified order: (d1.1) based upon the current values of said sensed operational parameters of said internal combustion engine, including the current value of rate of flow of intake air into said intake manifold, calculating the value of a first quantity representing the desired amount of fuel to be provided to said combustion chamber system of said internal combustion engine during the time period between the next two fuel injection pulse time points; (d1.2) updating the value of a second quantity representing the time smoothed desired amount of fuel to be provided to said combustion chamber system of said internal combustion engine during the time period between the next two fuel injection pulse time points, by adding to said second quantity representing the time smoothed desired amount of fuel to be provided to said combustion chamber system of said internal combustion engine during the time period between the next two fuel injecting pulse time points the value produced by subtracting said second quantity representing the time smoothed desired amount of fuel to be provided to said combustion chamber system of said internal combustion engine during the time period between the next two fuel injection pulse time points from said first quantity representing the desired amount of fuel to be provided to said combustion chamber system of said internal combustion engine during the time period between the next two fuel injection pulse time points and multiplying the result by a constant value less than unity; and (d1.3) optionally further modifying said second quantity representing the time smoothed desired amount of fuel to be provided to said combustion chamber system of said internal combustion engine during the time period between the next two fuel injection pulse time points according to engine operational parameters; and (d2) at time points in said operational cycle of said internal combustion engine and said fuel injection valve which are proper fuel injection time points, if according to the current operational conditions of said internal combustion engine it is proper to inject fuel through said fuel injection valve, performing the following processes in the specified order: (d2.1) calculating, from the current value of said second quantity representing the time smoothed desired amount of fuel to be provided to said combustion chamber system of said internal combustion engine during the time period between the next two fuel injection pulse time points, the value of a third quantity representing the actual fuel amount to be injected through said fuel injection valve in the next fuel injection pulse; and (d2.2) outputting to said interface device a fuel injection valve control electrical signal, based upon the value of said third quantity representing the actual fuel amount to be injected through said fuel injection valve in the next fuel injection pulse, such as to cause said fuel injection valve to open for a time period which will allow an amount of fuel approximately equal to the fuel amount represented by said third quantity representing the acutal fuel amount to be injected through said fuel injection valve in the next fuel injection pulse to pass through said fuel injection valve so as to be injected into said intake manifold.

According to such a structure, by said electronic computer thus time smoothing the value of said first quantity representing the desired amount of fuel to be provided to said combustion chamber system of said internal combustion engine during the time period between the next two fuel injection pulse time points in the way outlined to produce said second quantity representing the time smoothed desired amount of fuel to be provided to said combustion chamber system of said internal combustion engine during the time period between the next two fuel injection pulse time points, whose value thus pursues the value of said first quantity representing the desired amount of fuel to be provided to said combustion chamber system of said internal combustion engine during the time period between the next two fuel injection pulse time points, both during the operational conditions when fuel injection is being performed into said air-fuel mixture intake system, and also during the operational conditions when fuel injection into said air-fuel mixture intake system is being cut off, thereby fluctuations in the output signal of said intake air flow meter, due to overshooting thereof during acceleration, can be taken account of. Thus, the amount of fuel actually injected into said air-fuel mixture intake system through said fuel injection valve is adjusted, so as to ensure that approximately the correct amount of fuel actually reaches the combustion chamber system of the internal combustion engine, both during the operational conditions when fuel injection is being performed into said air-fuel mixture intake system, and also during the operational conditions when fuel injection into said air-fuel mixture intake system is being cut off. Thus, occurrence of the aforementioned undesirable initial rich spike during engine acceleration is again effectively prevented, and good engine fuel economy is promoted.

Further, according to a more particular device aspect of the present invention, these and other objects are more particularly and concretely accomplished by an engine control device of either one of the kinds described above, wherein said constant value is less than about 0.1, and in particular wherein said constant value is about 0.025.

According to such a structure, the characteristic time period, over which this time smoothing is performed by said electronic computer, is more than about ten times the time period taken by said electronic control computer to perform the actions detailed in step (d) above; and more particularly may be about forty times this time period.

Further, according to a more resticted device aspect of the present invention, these and other objects are more particularly and concretely accomplished by, for an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control device, comprising: (a) a plurality of sensors which sense the current values of certain operational parameters of said internal combustion engine, including an intake air flow meter which senses the current value of rate of flow of intake air into said intake mainfold; (b) an interface device, which, whenever it receives a fuel injection valve control electrical signal, dispatches said fuel injection valve actuating signal to said fuel injection valve; and (c) an electronic computer, which receives supply of signals from said sensors indicative of said current values of said certain operational parameters of said internal combustion engine, including a signal from said intake air flow meter indicative of the current value of rate of flow of the intake air into said intake manifold; (d) said electronic computer repeatedly and alternatingly and/or simultaneously: (d1) performing the following processes in the specified order: (d1.1) based upon the current values of said sensed operational parameters of said internal combustion engine, including the current value of rate of flow of intake air into said intake manifold, calculating the value of a first quantity representing the desired amount of fuel to be provided to said combustion chamber system of said internal combustion engine during the time period between the next two fuel injection pulse time points; (d1.2) updating the value of a second quantity representing the time smoothed desired amount of fuel to be provided to said combustion chamber system of said internal combustion engine during the time period between the next two fuel injection pulse time points, by adding to said second quantity representing the time smoothed desired amount of fuel to be provided to said combustion chamber system of said internal combustion engine during the time period between the next two fuel injection pulse time points the value produced by subtracting said second quantity representing the time smoothed desired amount of fuel to be provided to said combustion chamber system of said internal combustion engine during the time period between the next two fuel injection pulse time points from said first quantity representing the desired amount of fuel to be provided to said combustion chamber system of said internal combustion engine during the time period between the next two fuel injection pulse time points and multiplying the result by a constant value less than unity; and (d1.3) optionally further modifying said second quantity representing the time smoothed desired amount of fuel to be provided to said combustion chamber system of said internal combustion engine during the time period between the next two fuel injection pulse time points according to engine operational parameters; (d2) calculating the value of a third quantity representing the proportion of fuel in one pulse of fuel injected through said fuel injection valve which will adhere to said walls of said air-fuel mixture intake system, and the value of a fourth quantity representing the proportion of the total amount of fuel adhering to said walls of said air-fuel mixture intake system which is sucked off therefrom to pass into said combustion chamber system of said internal combustion engine during the time interval between two successive fuel injection pulses; and (d3) at time points in said operational cycle of said internal combustion engine and said fuel injections valve which are proper fuel injection time points, performing the following processes in the specified order: (d3.1) calculating, from the current value of a fifth quantity representing the total amount of fuel adhering to said walls of said air-fuel mixture intake system, and the current value of said fourth quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; (d3.2) calculating, from the current value of said second quantity representing the time smoothed desired amount of fuel to be provided to said combustion chamber system of said internal combustion engine during the time period between the next two fuel injection pulse time points, from the current value of said third quantity representing the proportion of fuel in one pulse of fuel injected through said fuel injection valve which will adhere to said walls of said air-fuel mixture intake system, and from the current value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it, the value of a seventh quantity representing the actual fuel amount to be injected through said fuel injection valve in the next fuel injection pulse; (d3.3) calculating, from the current value of said seventh quantity representing the actual fuel amount to be injected through said fuel injection valve in the next fuel injection pulse and the current value of said third quantity representing the proportion of fuel in one pulse of fuel injected through said fuel injection valve which will adhere to said walls of said air-fuel mixture intake system, the value of an eighth quantity representing the amount of fuel from the next fuel injection pulse that will adhere to said walls of said air-fuel mixture intake system; (d3.4) updating the value of said fifth quantity representing the total amount of fuel adhering to said walls of said air-fuel mixture intake system by adding thereto the value of said eighth quantity representing the amount of fuel from the next fuel injection pulse that will adhere to said walls of said air-fuel mixture intake system and by subtracting from the result of this addition the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; and (d3.5) outputting to said interface device a fuel injection valve control electrical signal, based upon the value of said seventh quantity representing the actual fuel amount to be injected through said fuel injection valve in the next fuel injection pulse, such as to cause said fuel injection valve to open for a time period which will allow an amount of fuel approximately equal to the fuel amount represented by said seventh quantity representing the acutal fuel amount to be injected through said fuel injection valve in the next fuel injection pulse to pass through said fuel injection valve so as to be injected into said intake manifold; wherein the method used by said electronic computer in subprocess (d3.2) for calculating the value of said seventh quantity representing the actual fuel amount to be injected through said fuel injection valve in the next fuel injection pulse is such that the sum of the value of said seventh quantity representing the actual fuel amount to be injected through said fuel injection valve in the next fuel injection pulse and the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it less the value of said eighth quantity representing the amount of fuel from the next fuel injection pulse that will adhere to said walls of said air-fuel mixture intake system is approximately equal to the value of said second quantity representing the time smoothed desired amount of fuel to be provided to said combustion chamber system of said internal combustion engine during the time period between the next two fuel injection pulse time points.

According to such a structure, said electronic computer also keeps account of the total amount of fuel adhering to the wall surfaces of the air-fuel mixture intake system, by performing the calculations detailed above; and according thereto the amount of fuel actually injected into said air-fuel mixture intake system through said fuel injection valve is adjusted by said electronic computer, so as to ensure that approximately the correct amount of fuel actually reaches the combustion chamber system of the internal combustion engine. Thus, occurrence of the aforementioned later following undesirable lean spike during engine acceleration is also effectively prevented.

Further, according to a more restricted device aspect of the present invention, these and other objects are more particularly and concretely accomplished by, for an internal combustion engine with a combustion chamber system and comprising an air-fuel mixture intake system formed with walls and comprising an intake manifold, said internal combustion engine further comprising a fuel injection valve fitted to said intake manifold which is selectively opened and closed by selective supply of an actuating signal thereto and which when so opened injects liquid fuel into said intake manifold, said internal combustion engine and said fuel injection valve operating according to an operational cycle: an engine control device, comprising: (a) a plurality of sensors which sense the current values of certain operational parameters of said internal combustion engine, including an intake air flow meter which senses the current value of rate of flow of intake air into said intake manifold; (b) an interface device, which, whenever it receives a fuel injection valve control electrical signal, dispatches said fuel injection valve actuating signal to said fuel injection valve; and (c) an electronic computer, which receives supply of signals from said sensors indicative of said current values of said certain operational parameters of said internal combustion engine, including a signal from said intake air flow meter indicative of the current value of rate of flow of intake air into said intake manifold; (d) said electronic computer repeatedly and alternatingly and/or simultaneously: (d1) performing the following processes in the specified order: (d1.1) based upon the current values of said sensed operational parameters of said internal combustion engine, including the current value of rate of flow of intake air into said intake manifold, calculating the value of a first quantity representing the desired amount of fuel to be provided to said combustion chamber system of said internal combustion engine during the time period between the next two fuel injection pulse time points; (d1.2) updating the value of a second quantity representing the time smoothed desired amount of fuel to be provided to said combustion chamber system of said internal combustion engine during the time period between the next two fuel injection pulse time points, by adding to said second quantity representing the time smoothed desired amount of fuel to be provided to said combustion chamber system of said internal combustion engine during the time period between the next two fuel injection pulse time points the value produced by subtracting said second quantity representing the time smoothed desired amount of fuel to be provided to said combustion chamber system of said internal combustion engine during the time period between the next two fuel injection pulse time points from said first quantity representing the desired amount of fuel to be provided to said combustion chamber system of said internal combustion engine during the time period between the next two fuel injection pulse time points and multiplying the result by a constant value less than unity; and (d1.3) optionally further modifying said second quantity representing the time smoothed desired amount of fuel to be provided to said combustion chamber system of said internal combustion engine during the time period between the next two fuel injection pulse time points according to engine operational parameters; (d2) calculating the value of a third quantity representing the proportion of fuel in one pulse of fuel injected through said fuel injection valve which will adhere to said walls of said air-fuel mixture intake system, and the value of a fourth quantity representing the proportion of the total amount of fuel adhering to said walls of said air-fuel mixture intake system which is sucked off therefrom to pass into said combustion chamber system of said internal combustion engine during the time interval between two successive fuel injection pulses; and (d3) at time points in said operational cycle of said internal combustion engine and said fuel injection valve which are proper fuel injection time points, performing the following processes in the specified order: (d3.1) calculating, from the current value of a fifth quantity representing the total amount of fuel adhering to said walls of said air-fuel mixture intake system, and the current value of said fourth quantity representing the proportion of the total amount of fuel adhering to said walls of said air-fuel mixture intake system which is sucked off therefrom to pass into said combustion chamber system of said internal combustion engine during the time interval between two successive fuel injection pulses, the value of a sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; and, if according to the current operational conditions of said internal combustion engine it is proper to inject fuel through said fuel injection valve, (d3.2) performing the following processes in the specified order: (d3.2.1) calculating, from the current value of said second quantity representing the time smoothed desired amount of fuel to be provided to said combustion chamber system of said internal combustion engine during the time period between the next two fuel injection pulse time points, from the current value of said third quantity representing the proportion of fuel in one pulse of fuel injected through said fuel injection valve which will adhere to said walls of said air-fuel mixture intake system, and from the current value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it, the value of a seventh quantity representing the actual fuel amount to be injected through said fuel injection valve in the next fuel injection pulse; (d3.2.2) calculating, from the current value of said seventh quantity representing the actual fuel amount to be injected through said fuel injection valve in the next fuel injection pulse and the current value of said third quantity representing the proportion of fuel in one pulse of fuel injected through said fuel injection valve which will adhere to said walls of said air-fuel mixture intake system, the value of a eighth quantity representing the amount of fuel from the next fuel injection pulse that will adhere to said walls of said air-fuel mixture intake system; (d3.2.3) updating the value of said fifth quantity representing the total amount of fuel adhering to said walls of said air-fuel mixture intake system by adding thereto the value of said eighth quantity representing the amount of fuel from the next fuel injection pulse that will adhere to said walls of said air-fuel mixture intake system and by subtracting from the result of this addition the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; (d3.2.4) modifying said actuating signal according to the value of said seventh quantity representing the acutal fuel amount to be injected through said fuel injection valve in the next fuel injection pulse; and (d3.2.5) outputting to said interface device a fuel injection valve control electrical signal, based upon the value of said seventh quantity representing the actual fuel amount to be injected through said fuel injection valve in the next fuel injection pulse, such as to cause said fuel injection valve to open for a time period which will allow an amount of fuel approximately equal to the fuel amount represented by said seventh quantity representing the actual fuel amount to be injected through said fuel injection valve in the next fuel injection pulse to pass through said fuel injection valve so as to be injected into said intake manifold; but otherwise, if according to the current operational conditions of said internal combustion engine it is not proper to inject fuel through said fuel injection valve, (d3.3) performing the following process: (d3.3.1) updating the value of said fifth quantity representing the total amount of fuel adhering to said walls of said air-fuel mixture intake system by subtracting therefrom the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it; wherein the method used by said electronic computer in subprocess (d3.2.1) for calculating the value of said seventh quantity representing the actual fuel amount to be injected through said fuel injection valve in the next fuel injection pulse is such that the sum of the value of said seventh quantity representing the actual fuel amount to be injected through said fuel injection valve in the next fuel injection pulse and the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it less the value of said eighth quantity representing the amount of fuel from the next fuel injection pulse that will adhere to said walls of said air-fuel mixture intake system is approximately equal to the value of said second quantity representing the time smoothed desired amount of fuel to be provided to said combustion chamber system of said internal combustion engine during the time period between the next two fuel injection pulse time points.

According to such a structure, said electronic computer also keeps account of the total amount of fuel adhering to the wall surfaces of the air-fuel mixture intake system, by performing the calculations detailed above, both during the operational conditions when fuel injection is being performed into said air-fuel mixture intake system, and also during the operational conditions when fuel injection into said air-fuel mixture intake system is being cut off; and according thereto the amount of fuel actually injected into said air-fuel mixture intake system through said fuel injection valve is adjusted by said electronic computer, so as to ensure that approximately the correct amount of fuel actually reaches the combustion chamber system of the internal combustion engine, both during the operational conditions when fuel injection is being performed into said air-fuel mixture intake system, and also during the operational conditions when fuel injection into said air-fuel mixture intake system is being cut off. Thus, occurrence of the aforementioned later following undesirable lean spike during engine acceleration is also effectively prevented.

Further, according to a more particular device aspect of the present invention, these and other objects are more particularly and concretely accomplished by either one of the last two engine control devices described above, wherein the method used by said electronic computer for calculating the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse time instant and the next fuel injection pulse time instant after it is to multiply the value of said fifth quantity representing the total amount of fuel adhering to said walls of said air-fuel mixture intake system by the value of said fourth quantity representing the proportion of the total amount of fuel adhering to said walls of said air-fuel mixture intake system which is sucked off therefrom to pass into said combustion chamber system of said internal combustion engine during the time interval between two successive fuel injection pulses.

According to such a structure, said electronic control computer calculates said sixth value representing the amount of fuel from the total amount of fuel adhering to said walls of said air-fuel mixture intake system which will be sucked off therefrom simply and yet effectively. It has been shown, by the aforementioned process of experiment, that this method of calculation is adequate for predicting the value of the sucked off amount of fuel.

Further, according to another more particular device aspect of the present invention, these and other objects are more particularly and concretely accomplished by any single one of the engine control devices described above, wherein the method used by said electronic computer for calculating the value of said seventh quantity representing the actual fuel amount to be injected through said fuel injection valve in the next fuel injection pulse is to subtract from the value of said second quantity representing the time smoothed desired amount of fuel to be provided to said combustion chamber system of said internal combustion engine during the time period between the next two fuel injection pulse time points the value of said sixth quantity representing the amount of fuel from the total amount of fuel adhering to said walls of said air-fuel mixture intake system which will be sucked off therefrom to pass into said combustion chamber system of said internal combustion engine in the time interval between the next fuel injection pulse and the next fuel injection pulse after it, and to divide the result by unity less the value of said third quantity representing the proportion of fuel in one pulse of fuel injected through said fuel injection valve which will adhere to said walls of said air-fuel mixture intake system.

According to such a structure, said electronic control computer calculates said seventh value representing the actual fuel amount to be injected through said fuel injection valve in the next fuel injection pulse simply and yet effectively, by a formula which will be explained in detail in the portion of this specification entitled "DESCRIPTION OF THE PREFERRED EMBODIMENT". It has been shown, by the aforementioned process of experiment, that this method of calculation is adequate for predicting the value of the sucked off amount of fuel.

Further, according to yet another more particular device aspect of the present invention, these and other objects are more particularly and concretely accomplished by any single one of the engine control devices described above, wherein the method used by said electronic computer for calculating the value of said eighth quantity representing the amount of fuel from the next fuel injection pulse that will adhere to said walls of said air-fuel mixture intake system is to multiply the value of said seventh quantity representing the actual fuel amount to be injected through said fuel injection valve in the next fuel injection pulse by the value of said third quantity representing the proportion of fuel in one pulse of fuel injected through said fuel injection valve which will adhere to said walls of said air-fuel mixture intake system.

According to such a structure, said electronic control computer calculates said eighth quantity representing the amount of fuel from the next fuel injection pulse that will adhere to said walls of said air-fuel mixture intake system simply and yet effectively. It has been shown, by the aforementioned process of experiment, that this method of calculation is adequate for predicting the value of the sucked off amount of fuel.

BRIEF DESCRIPTION OF THE DRAWINGS

The present invention will now be shown and described with reference to a preferred embodiment of both the method and the device thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENT

Now, the present invention will be explained with respect to the preferred embodiment thereof, and with reference to the accompanying drawings.

Figure 1:
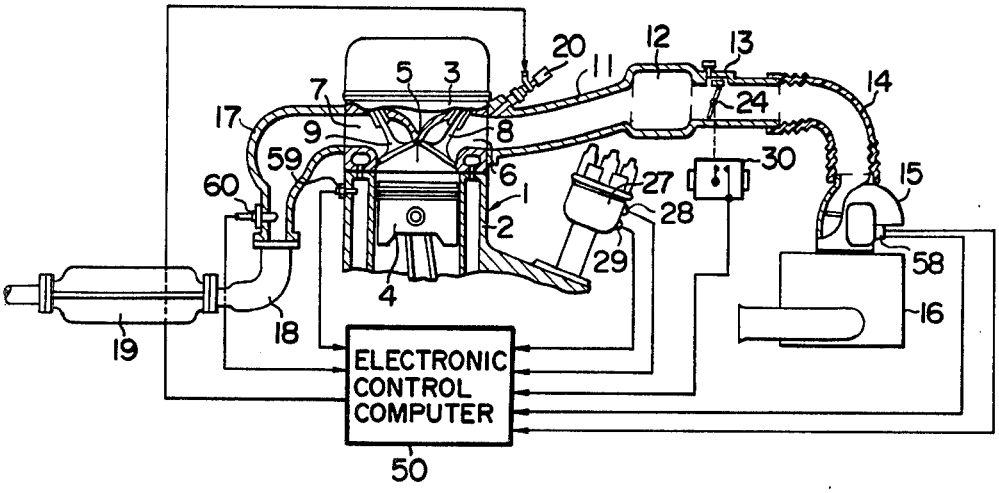
FIG. 1 is a partly schematic partly cross sectional drawing, diagrammatically showing an example of an internal combustion engine which is equipped with a fuel injection system and which is suitable to be controlled by an embodiment of the engine control device according to the present invention, said fuel injection system being of the L-jetronic type incorporating an intake air flow meter which comprises an intake air amount or rate sensor, according to an embodiment of the engine control method of the present invention; this figure also showing in schematic part block diagram form the preferred embodiment of the engine control device according to the present invention, which practices the preferred embodiment of the engine control method according to the present invention, and which controls said internal combustion engine.

In FIG. 1 there is shown a part schematic part cross sectional diagram of an internal combustion engine, generally designated by the reference numeral 1, which is a fuel injection type of engine comprising a fuel injection system which is per se well known, and which is controlled according to the preferred embodiment of the engine control method according to the present invention by the preferred embodiment of the engine control device according to the present invention, as will henceforth be explained.

The internal combustion engine 1 comprises a conventional type of cylinder block 2, within which are formed a plurality of cylinder bores, only one of which can be seen in the drawing. To the top ends of the cylinder bores remote from the crankshaft of the internal combustion engine 1, i.e. to the upper end of the cylinder bore as seen in the figure, there is fitted a cylinder head 3, and within each of the bores there reciprocates a piston 4 in a per se well known way. Thus, the bores, the top surfaces of the pistons 4, and the bottom surface of the cylinder head 3 cooperate in a per se well known way to form a plurality of combustion chambers 5, only one of which, again, can be seen in the drawing.

Each of the combustion chambers 5 is provided with an intake port 6 and an exhaust port 7, and these ports 6 and 7 are each respectively controlled by one of a plurality of intake valves 8 or one of a plurality of exhaust valves 9. Further, spark ignition is provided for each combustion chamber 5 by one of a plurality of spark plugs which cannot be seen in the figures, each of which is provided at appropriate times with high tension electrical energy from an ignition coil not shown in the figures via a distributor 27, so as to cause said spark plug to spark, in a per se well known way.

To the exhaust ports 7 of the internal combustion engine 1 there is connected an exhaust manifold 17 which leads the exhaust gases of the engine from the combustion chambers 5 to an exhaust pipe 18, and at an intermediate part of this exhaust pipe 18 there is fitted a three way catalytic converter 19. To the intake ports 6 of the internal combustion engine 1 there is connected an intake manifold 11 which leads to an intake air surge tank 12. To this surge tank 12 there is connected a throttle body 13, to which, via an intake tube 14 and an air flow meter 15, there is communicated an air cleaner 16. Thus, air flows in from the atmosphere through, in order, the air cleaner 16, the air flow meter 15, the intake tube 14, the throttle body 13, the surge tank 12, and the intake manifold 11, to enter into the combustion chambers 5 of the internal combustion engine 1, when sucked in through the intake ports 6 by the pistons 4 as they move downwards as seen in the figure on their intake strokes.

To an intermediate part of the intake manifold 11 there is fitted a fuel injection valve 20 of a per se well known electrically controlled sort. This fuel injection valve 20 is supplied with pressurized liquid fuel such as gasoline from a fuel tank, not shown in the figures, by a fuel pump also not shown in the figures and also of a per se well known sort, and the opening and closing of this fuel injection valve 20 are electrically controlled by an electronic control computer 50 which will hereinafter be described, which forms part of the preferred embodiment of the engine control device according to the present invention, which functions according to the preferred embodiment of the engine control method according to the present invention. Thus, according to the duration of the interval of time between said opening of said fuel injection valve 20 and said closing of said fuel injection valve 20, the amount of liquid fuel such as gasoline injected into the intake manifold 11 per one cycle of operation of said fuel injection valve 20 can be regulated.

A throttle valve 24 which in this shown internal combustion engine 1 is a butterfly type throttle valve is mounted at an intermediate point in the through passage in the throttle body 13 so as to control its air flow resistance, i.e. the effective cross section of said passage, and this throttle valve 24 is controlled by a linkage which is not shown in the figures according to the amount of depression of a throttle pedal also not shown in the figures provided by actuating movement of the foot of the driver of the vehicle which is powered by this internal combustion engine 1.

This completes the description of the parts of the internal combustion engine 1, and of the associated systems thereof, and of the fuel injection system of the internal combustion engine 1, which are controlled according to the aforesaid preferred embodiment of the engine control method according to the present invention by the preferred embodiment of the engine control device according to the present invention. This engine control device comprises a plurality of sensors (seven, in fact) which will now be described, and also comprises an electronic control computer 50 which may be a microcomputer, and which will be described shortly with respect to its architecture and its mode of operation. Together, these sensors furnish signals which convey information to the electronic control computer 50 relating to operational conditions of the internal combustion engine 1, and based upon this information about engine operational conditions the electronic control computer 50 dispatches electrical signals to the fuel injection valve 20 so as appropriately to operate and to control the internal combustion engine 1, according to the aforesaid preferred embodiment of the engine control method according to the present invention.

These signals are: (1) a standard position signal generated by a standard position sensor 28 fitted to the distributor 27; (2) a crank angle signal which is generated by a crank angle or revolution sensor 29 fitted to the distributor 27; (3) an intake air temperature signal generated by an intake air temperature sensor 58 which is fitted in the air flow meter 15 in order to sense the temperature of the air which is being taken in therethrough; (4) a cooling water temperature signal generated by a cooling water temperature sensor 59 which is attached to the cylinder block 2 in order to to sense the temperature of the cooling water within the water jacket thereof; (5) an excess air signal generated by an O2 sensor 60 of a per se well known sort which is fitted to the exhaust manifold 17 and which generates said excess air signal which is representative of the air/fuel ratio of the exhaust gases of the internal combustion engine 1 which are being exhausted through said exhaust manifold 17; (6) a throttle idling signal which is produced by a throttle idling limit switch 30 which is coupled to the movement of said throttle valve 24 or to the movement of said linkage, not particularly shown, which drives said throttle valve 24, said throttle idling limit switch 30 indicating by its output signal whether the throttle valve 24 is in its fully closed or idling position or not; and (7) an intake air flow amount or rate signal which is generated by an intake air flow amount or rate sensor 37 incorporated in the intake air flow rate or amount meter 15.

Figure 2:
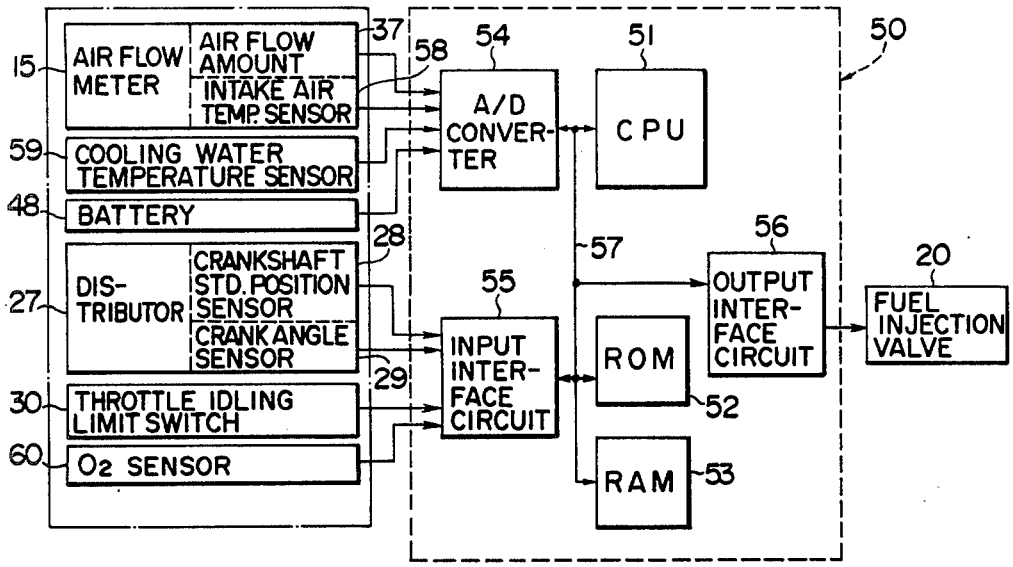
FIG. 2 is a more detailed block diagram, showing the preferred embodiment of the control device according to the present invention for controlling the engine shown in FIG. 1 in more detail with regard to the internal construction of an electronic computer incorporated therein, and also showing parts of said internal combustion engine, also in block diagrammatical form.

The general large scale internal architecture of the electronic control computer 50 is shown in FIG. 2. The control computer 50 comprises: a central processing unit or CPU 51; a read only memory or ROM 52; a random access memory or RAM 53; an analog to digital converter or A/D converter 54 of a sort which is per se well known in the art; an input interface circuit 55 also of a sort which is per se well known in the art, and which includes a buffer memory; and an output interface circuit 56 also of a sort which is per se well known in the art. All of these parts are mutually interconnected by a common bus 57. The CPU 51 is as a matter of course provided with a clock signal from a clock pulse signal generator of a per se well known sort.

The standard position signal generated by the standard position sensor 28 fitted to the distributor 27 is sent to the input interface circuit 55. The crank angle signal which is generated by the aforementioned crank angle or revolution sensor 29 fitted to the distributor 27 is sent to the input interface circuit 55. The intake air temperature signal generated by the intake air temperature sensor 58 which is fitted in the air flow meter 15 is sent to the analog to digital converter or A/D converter 54. The cooling water temperature signal generated by the cooling water temperature sensor 59 which is attached to the cylinder block 2 in order to to sense the temperature of the cooling water within the water jacket thereof is sent to the analog to digital converter or A/D converter 54. The excess air signal generated by the O2 sensor 60 which is fitted to the exhaust manifold 17 in order to detect the air/fuel ratio of the exhaust gases of the internal combustion engine 1 which are being exhausted through said exhaust manifold 17 is sent to the analog to digital converter or A/D converter 54. The throttle idling signal which is produced by the throttle idling limit switch 30 which is coupled to the movement of said throttle valve 24 or to the movement of said linkage, not particularly shown, which drives said throttle valve 24 is sent to the input interface circuit 55. A signal from the battery 48 of the vehicle to which the internal combustion engine 1 is fitted, said signal indicating the voltage currently being delivered by said battery, is sent to the input interface circuit 55. Finally, the intake air flow amount or rate signal which is generated by the intake air flow amount or rate sensor 37 incorporated in the intake air flow rate or amount meter 15 is sent to the input interface circuit 55.

The A/D converter 54 converts the analog value of the cooling water temperature signal which is generated by the cooling water temperature sensor 59 attached to the cylinder block 2 into a digital value representative thereof, at an appropriate timing under the control of the CPU 51, and feeds this digital value to the CPU 51 and/or the RAM 53, as appropriate, again at an appropriate timing under the control of the CPU 51. The A/D converter 54 also converts the analog value of the intake air temperature signal which is generated by the intake air temperature sensor 58 fitted in the air flow meter 15 into a digital value representative thereof, again at an appropriate timing under the control of the CPU 51, and feeds this digital value to the CPU 51 and/or the RAM 53, as appropriate, again at an appropriate timing under the control of the CPU 51. The A/D converter 54 also converts the analog value of the intake air flow amount or rate signal which is generated by the intake air flow amount or rate sensor 37 incorporated in the intake air flow rate or amount meter 15 into a digital value representative thereof, again at an appropriate timing under the control of the CPU 51, and feeds this digital value to the 51 and/or the RAM 53, as appropriate, again at an appropriate timing under the control of the CPU 51. Finally, the A/D converter 54 also converts the analog value of the voltage of the battery 48 of the vehicle into a digital value representative thereof, again at an appropriate timing under the control of the CPU 51, and feeds this digital value to the CPU 51 and/or the RAM 53, as appropriate, again at an appropriate timing under the control of the CPU 51.

Further, the excess air signal which is generated by the O2 sensor 60 fitted to the exhaust manifold 17 is fed to the input interface circuit 55 which supplies said value to the CPU 51 and/or the RAM 53, as appropriate, again at an appropriate timing under the control of the CPU 51. The crankshaft standard position signal which is generated by the aforementioned crankshaft standard position sensor 28 fitted to the distributor 27 is also fed to the input interface circuit 55 which supplies said value to the CPU 51 and/or the RAM 53, as appropriate, again at an appropriate timing under the control of the CPU 51. The crank angle or revolution signal which is generated by the aforementioned crank angle or revolution sensor 29 fitted to the distributor 27 is also fed to the input interface circuit 55 which supplies said value to the CPU 51 and/or the RAM 53, as appropriate, again at an appropriate timing under the control of the CPU 51. Finally, the throttle idling signal which is generated by the throttle idling limit switch 30 which is coupled to the movement of said throttle valve 24 or to the movement of said linkage which drives said throttle valve 24 is similarly fed to the input interface circuit 55 which supplies said value to the CPU 51 and/or the RAM 53, as appropriate, again at an appropriate timing under the control of the CPU 51. The details of these analog to digital conversions, and of these input processes, described above, based upon the disclosure in this specification, will be easily filled in by one of ordinary skill in the computer programming art.

The CPU 51 operates as will hereinafter be more particularly described, according to a control program stored in the ROM 52, on these digital data values and others, and from time to time, i.e. whenever it is the proper timing instant to start injecting a pulse of gasoline through the fuel injection valve 20 into the intake manifold 11, produces a digital output signal whose magnitude is representative of the desired magnitude of said fuel injection pulse, said digital output signal being fed to the output interface circuit 56. This output interface circuit 56 supplies this output signal in digital form to a fuel injection valve control system comprised therein, which may comprise a down counter, a flipflop, and an amplifier.

The fuel injection valve control system processes this signal from the output interface circuit 56 representative of fuel injection amount when said signal is received, immediately at this time outputs a control electrical signal to the fuel injection valve 20 to open said fuel injection valve 20, and at a proper time later outputs a control electrical signal to said fuel injection valve so as to close said fuel injection valve 20 again, after a fuel injection pulse of said desired magnitude has been injected through said fuel injection valve 20. In more detail, the operation of this circuit, which is not particularly shown in any of the figures, may be as follows. When the signal representative of fuel injection amount is output by the output interface circuit 56, this signal is supplied to the SET terminal of the aforementioned flipflop, so as to cause the output of said flipflop to be energized, said output of said flipflop being then amplified by said amplifier and being supplied to the fuel injection valve 20 so as to open it. The signal representative of fuel injection amount output by the output interface circuit 56 is also supplied to the aforementioned down counter, which is thus set to the value of said signal representative of the amount of fuel to be injected when said signal is supplied by the CPU 51 of the electronic computer 50. The down counter then subsequently counts down from this value according to the clock signal supplied by the clock pulse signal generator, previously mentioned but also not particularly shown in any of the figures. Further, in this arrangement, when the value in the down counter reaches zero, then the down counter outputs a pulse to the RESET terminal of the flipflop, and this pulse thus RESETs the flipflop and causes its output to cease to be energized, so as thereby via said amplifier to close the fuel injection valve 20 so as to terminate the supply of liquid fuel through the fuel injection valve 20 into the intake manifold 11 of the internal combustion engine 1. By this arrangement, the duration of the pulse of injected liquid fuel is made to be proportional to the signal value outputted by the CPU 51 through the output interface circuit 56, and the time instant of the start of the opening period of the fuel injection valve 20 is substantially coincident with the time instant of dispatch of said signal from the CPU 51 to the output interface circuit 56.

Figure 3:
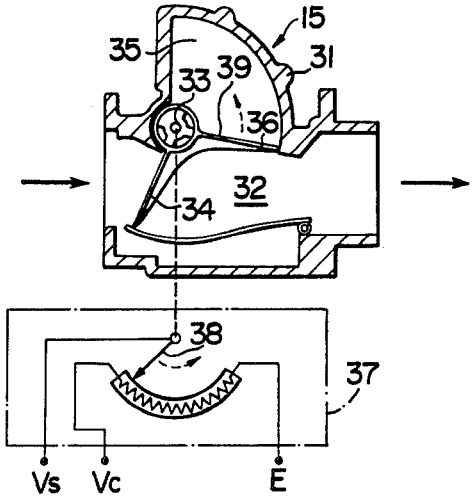
FIG. 3 is a sectional view through said intake air flow meter incorporated in said internal combustion engine shown in FIG. 1, showing its internal construction including a flapper in detail, and also showing in diagrammatical form said intake air amount or rate sensor, which is part of the preferred embodiment of the engine control device according to the present invention.

In FIG. 3, there is given a sectional view through said intake air flow meter 15, showing its internal construction in detail, and also showing in diagrammatical form said intake air amount or rate sensor 37, which is part of the preferred embodiment of the engine control device according to the present invention. The intake air flow meter 15 comprises a case 31, through which there is formed an intake air through passage 32. At one side of this intake air through passage 32 (the upper side in the figure) there passes transversely a pivot 33, on which there is pivoted a measuring element or flapper 39 of generally L-shaped cross section, the lower arm portion of the L-shape of said flapper 39 projecting into the intake air through passage 32 and being designated by the reference numeral 34 in the figure, and the upper arm portion of the L-shape of said flapper 39 being located within and delimiting a damping chamber 35 formed in the case 31 to the side of the intake air through passage 32, and being designated by the reference numeral 36 in the figure. The flapper element 39 is biased in the clockwise direction as seen in the figure by a spring not shown in the figure, and is pushed in the anticlockwise direction as seen in the figure by the intake air which is rushing through the air flow meter 15, as shown by the arrows, through the intake air through passage 32 from the left of the figure to the right of the figure. As the flapper element 39 turns to and fro in the body 31, according to the magnitude of this intake air stream, its movement is damped by the upper arm portion 36 of the flapper element 39 moving to and fro to expand and contract the size of the damping chamber 35, since the edges of this upper arm portion 36 of the flapper element closely cooperate with the parts of the case 31 which define this damping chamber 35, thus forming a rough air seal thereagainst. However, as will be explained later, a degree of overshoot of the intake air flow meter 15 is still troublesome.

To the movement of the flapper element 39 of the intake air flow meter 15 there is coupled the movement of the movable arm 38 of a potentiometer, which thus constitutes the aforesaid intake air amount or rate sensor 37, and which is supplied with a constant supply voltage at its terminal designated by "Vc" in the figure, while its terminal designated by "E" in the figure is earthed or grounded. Thus at the terminal of the potentiometer 37 designated by "Vs" in the figure there is provided an electrical signal which is indicative of the currently positioned angle of the flapper element 39, i.e. of the amount of air flow that is currently passing through the intake air through passage 32, i.e. of the amount of air that currently is being aspired into the internal combustion engine 1.

Figure 4:
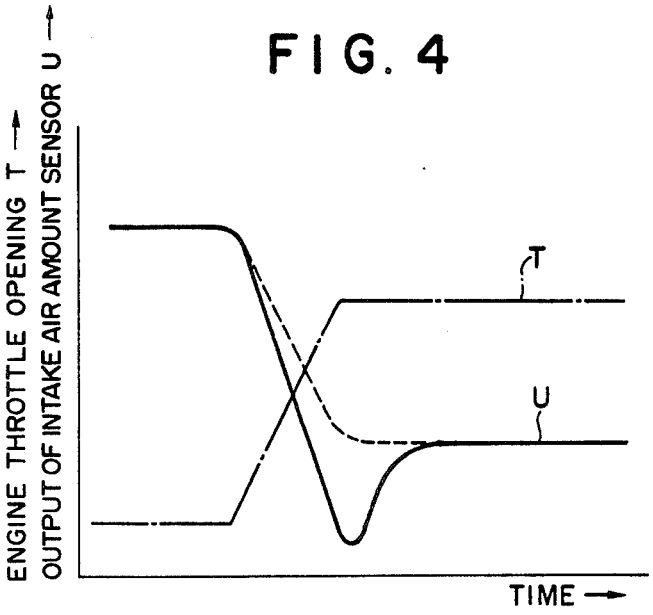
FIG. 4 is a time chart, in which engine throttle opening and also output of said intake air amount or rate sensor are both shown on the ordinate and time is shown on the abscissa, showing respectively by the single dotted line, by the solid line, and by the dashed line the concurrent variation with respect to time of the engine throttle opening, the variation of the signal output by said intake air amount or rate sensor incorporated in said intake air flow meter which is indicative of the rotational angle of said flapper incorporated therein, and the variation of the actual rate of flow of intake air which is actually being sucked into said intake manifold through said intake air flow meter, during an accelerational engine operational episode, and showing that said flapper tends to overshoot its proper position during acceleration of the internal combustion engine, so that at this time said intake air amount or rate sensor indicates for a short transient time, immediately after start of acceleration, a substantially greater value for intake air amount than the correct amount.

In FIG. 4 there is shown a time chart, in which engine throttle opening and also output of said intake air amount or rate sensor 37 are both shown on the ordinate and time is shown on the abscissa. The single dotted line shows the variation with respect to time of the engine throttle opening, during an engine operational episode in which the throttle valve 24 of the internal combustion engine 1 is opened quite sharply, in other words the internal combustion engine 1 is accelerated sharply. The solid line shows the concurrent variation with respect to time of the signal output by said intake air amount or rate sensor 37 incorporated in said intake air flow meter 15, which is indicative of the rotational angle of said flapper element 39 incorporated therein; and the dashed line shows the variation with respect to time of the actual rate of flow of intake air which is actually being sucked into said intake manifold 11 through said intake air through passage 32 in said intake air flow meter 15. It will be seen from these graphs that said flapper element 39 tends to overshoot its proper position during the initial phase of sharp acceleration of the internal combustion engine 1, so that at this time said intake air amount or rate sensor 37 indicates, for a short transient time immediately after start of acceleration, a substantially greater value for intake air amount than the correct amount. It will of course be appreciated by those skilled in the art that, if the amount of fuel injected through the fuel injection valve 20 into the intake manifold 11 is based directly upon this erroneous signal provided by the overshooting flapper element 39 which moves the movable arm 38 of the intake air amount or rate sensor 37, then during this overshooting time, just after the start of engine acceleration, too much fuel will be supplied to the internal combustion engine 1, and a rich spike will be caused in the air-fuel mixture supplied to said engine. This will cause considerable variation of the acceleration being provided by the internal combustion engine 1, i.e. will cause jerk or torque shock during the intial phase of acceleration. Further, it has been found that merely increasing the amount of damping of the movement of the flapper element 39 provided by said damping chamber 35 and said upper arm portion 36 of said flapper element 39 is not adequate to solve this problem, since over damping of the movement of said flapper element 39 is unduly restrictive of its movement. Accordingly, another way was required to be found, and the present invention answers this problem, as will be seen hereinafter.

Another problem which is present in the prior art operation of a fuel injection system, which interacts synergistically with the just mentioned problem, will now be explained. In the prior art type of fuel injection system in which no consideration is given to the effect of adhesion of fuel on the wall surfaces of the air intake passage and of the intake ports, and to the effect of sucking off of said fuel, when the engine is accelerated of course the throttle valve in the air intake system is opened, and together with this the amount of fuel being injected through the fuel injection valve is simultaneously increased, but because a substantial proportion of this extra injected fuel tends to adhere or accumulate in the liquid layer or film on the wall surfaces of the air intake passage and of the intake port, thus increasing the total volume of fuel in this liquid layer or film, thereby the air-fuel mixture actually being supplied into the combustion chambers of the internal combustion engine becomes over lean; in other words, a lean spike of air-fuel mixture occurs during engine acceleration.

Figure 8:
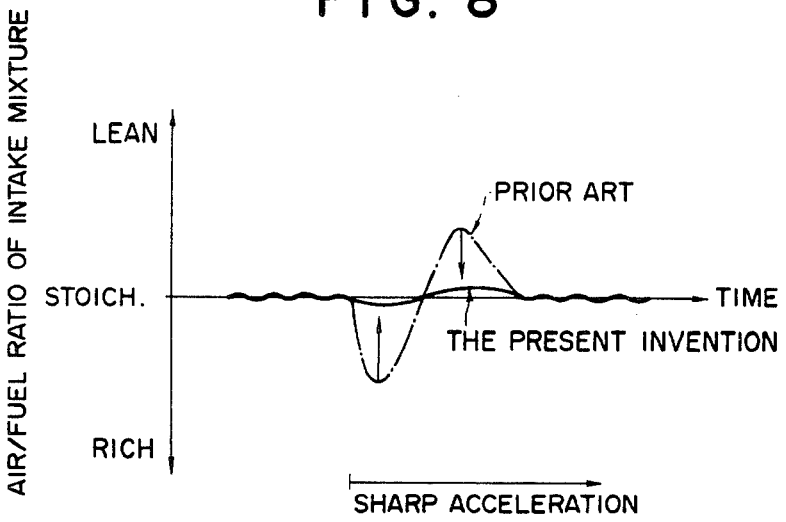
FIG. 8 is a time chart, in which air/fuel ratio of delivered air-fuel mixture is shown on the ordinate and time is shown on the abscissa, showing by the solid line the behavior of variation of air/fuel ratio of the intake air-fuel mixture of an internal combustion engine with a fuel injection system controlled according to the preferred embodiment of the engine control method according to the present invention, as contrasted with the behavior of variation of air/fuel ratio of the air-fuel mixture of an engine with a fuel injection system controlled according to a prior art method of engine control, which is shown by the single dotted line, both these variation behaviors being shown during a similar sharp acceleration engine operational episode to the episode illustrated in FIGS. *7a, 7b,* and *7c;* and showing that during steady operation of the internal combustion engine both the air/fuel ratio of the air-fuel mixture in the engine controlled according to the present invention and the air/fuel ratio of the air-fuel mixture in the engine controlled in a prior art fashion are substantially stoichiometric; but that during sharp acceleration of the engine, whereas the air/fuel ratio of the air-fuel mixture in the engine controlled in a prior art fashion deviates substantially from stoichiometric first towards the rich side and then immediately subsequently towards the lean side, i.e. undergoes in rapid succession first a rich spike and then a lean spike, by contrast the air/fuel ratio of the air-fuel mixture in the engine controlled according to the present invention does not deviate substantially from stoichiometric, i.e. does not undergo any substantial rich spike followed by a lean spike.
Figure 9:
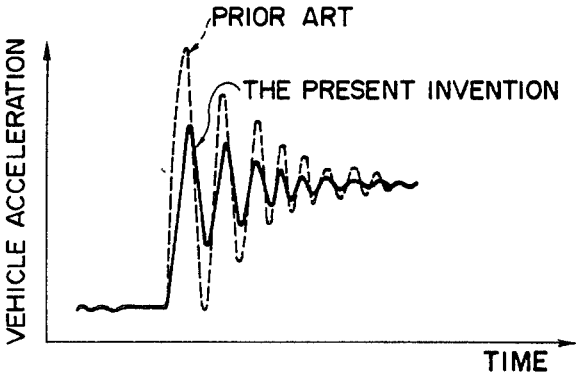
FIG. 9 is a time chart, in which vehicle acceleration is shown on the ordinate and time is shown on the abscissa, said abscissa corresponding to and indicating the same time as the abscissa of FIG. 8, showing by the solid line the behavior of variation of vehicle acceleration of a vehicle incorporating an internal combustion engine with a fuel injection system controlled according to the preferred embodiment of the engine control method according to the present invention, as contrasted with the behavior of variation of vehicle acceleration of a vehicle incorporating an internal combustion engine with a fuel injection system controlled according to a prior art method of engine control, which is shown by the dashed line, during the same engine sharp acceleration operational episode as the engine operational episode illustrated in FIG. 8, and showing that when the vehicle incorporating an internal combustion engine with a fuel injection system controlled according to the preferred embodiment of the engine control method according to the present invention is sharply accelerated, it undergoes much less fore and aft shock and vibration and variation of acceleration, i.e. jerk, than does a vehicle incorporating an internal combustion engine with a fuel injection system controlled according to a prior art method which is similarly sharply accelerated.

Now, this lean spike takes a little time to appear after the start of engine acceleration, and in fact tends to occur just after the end of the rich spike of air-fuel mixture explained above which tends to appear as a result of overshooting of the air flow meter 15. Referring to the single dotted line in FIG. 8, which is a time chart in which air/fuel ratio of delivered air-fuel mixture is shown on the ordinate and time is shown on the abscissa, there is shown the behavior of variation of air/fuel ratio of the air-fuel mixture of an engine with a fuel injection system controlled according to a prior art method of engine control, during a sharp acceleration engine operational episode. It will be seen that the air/fuel ratio of the air-fuel mixture in the engine thus controlled in a prior art fashion deviates substantially from stoichiometric first towards the rich side and then immediately subsequently towards the lean side, i.e. undergoes in rapid succession first a rich spike and then a lean spike. Referring next to FIG. 9, which is a time chart in which vehicle acceleration is shown on the ordinate and time is shown on the abscissa, said abscissa corresponding to and indicating the same time as the abscissa of FIG. 8, there is shown by the dashed line the behavior of variation of vehicle acceleration of said vehicle incorporating an internal combustion engine with a fuel injection system controlled according to said prior art method of engine control, during the same engine sharp acceleration operational episode as illustrated in FIG. 8. It will be seen that when the vehicle incorporating an internal combustion engine with a fuel injection system controlled in a prior art fashion is sharply accelerated, it undergoes quite violent fore and aft shock and vibration and variation of acceleration, i.e. jerk. This is because of the combined or synergistic effects of the aforementioned rich spike and lean spike following one another in quick succession, which cause much more jerk than would either alone. Thus the present invention has been formulated, in an effort to control this problem.

A summary of the way of operation of the electronic control computer 50, which causes the preferred embodiment of the engine control method according to the present invention to be practiced by the preferred embodiment of the engine control device according to the present invention, will now be given. By the way, it should be first understood that in the control program of this electronic control computer 50 amounts of fuel to be injected through the fuel injection valve 20 are measured in time units of opening of said fuel injection valve 20, since the pressure of the supply of liquid fuel to the fuel injection valve 20 is essentially constant and hence these concepts are interchangeable for calculation purposes, if suitably interconverted by constant factors, which may be conveniently arranged to be unity. Thus, in the following discussions, times of opening of the fuel injection valve 20 and amounts of fuel to be injected therethrough will be spoken of without particular distinction between them.

A main routine of the electronic control computer 50, which will be detailed later with reference to the flow chart of FIG. 5 which is a flow chart of said main routine, is executed in a repetitive cycle whenever the ignition circuit of the automotive vehicle incorporating the internal combustion engine 1 is switched on. This main routine loops from its end to substantially its beginning, and one execution of the loop of this main routine takes about three milliseconds, which corresponds, when the crankshaft of the internal combustion engine is rotating at a typical speed of roughly 4000 rpm, to approximately 72° of crank angle.

In more detail, this main routine calculates the appropriate value for the amount of fuel to be supplied to the combustion chambers 5 of the internal combustion engine 1 for each engine fuel injection operational cycle (which, according to engine design, may correspond to one crankshaft revolution through a total angle of 360°, two crankshaft revolutions through a total angle of 720°, or some other value), repeatedly, according to the current or latest values of detected engine operational parameters which said main routine inputs, i.e. of: (1) intake air temperature as sensed by the intake air temperature sensor 58 fitted in the air flow meter 15; (2) engine cooling water temperature as sensed by the cooling water temperature sensor 59 attached to the cylinder block 2; (3) excess air as sensed by the O2 sensor 60 fitted to the exhaust manifold 17; (4) throttle idling condition as sensed by the throttle idling limit switch 30; (5) intake air flow amount or rate as sensed by the intake air flow amount or rate sensor 37; and (6) the output voltage of the battery 48 of the vehicle. Derivation of the current value of the engine revolution speed N is not performed in this input process, but is performed in an interrupt routine, to be described shortly. In detail, according to the functioning of the shown perferred embodiment of the engine control device according to the present invention, which practices the preferred embodiment of the engine control method according to the present invention, provided that the internal combustion engine 1 is operating under its own power and is not being started by cranking (which case is considered separately and treated specially as will be seen hereinafter), a basic amount BF of fuel to be supplied to the combustion chambers 5 is calculated from the current values of intake air flow amount or rate and engine revolution speed, according to the basic and per se well known principle of the L-jetronic fuel injection control system, and then this basic amount BF of fuel to be supplied is time smoothed over successive iterations of this main routine whose flow chart is being explained, according to the formula $CBF=CBF+(BF-CBF)*F$, which will be more fully explained later, and which causes the value of CBF to pursue the value of BF in a time smoothed fashion, so that whenever the value of BF remains static the value of CBF quickly becomes substantially equal thereto, after a characteristic number of iterations or repetitions of the main routine which is determined by the reciprocal of the constant F. The constant F may be in the range below about 0.1, and more particularly may be about 0.025, thus determining this characteristic number of iterations at more than about ten, and more particularly at about forty. Then, finally, this corrected basic amount CBF of fuel to be supplied is again corrected first according to the value of intake air temperature and optionally also other engine operational parameters, second according to the value of the excess air signal dispatched from the oxygen sensor 60 so as to cause the air/fuel ratio of the exhaust gases in the exhaust manifold 17 to home in on the stoichiometric value by a feedback process as already explained in outline in the portion of this specification entitled "BACKGROUND OF THE INVENTION", and third according to the temperature of the intake air which is being aspired into the internal combustion engine 1. Thus a desired amount of fuel DFC to be supplied into the combustion chambers 5 of the internal combustion engine 1 is calculated.

The other and very important function of this main routine that it performs is to calculate two coefficients, AWC or the wall adhere coefficient, and SOC or the sucking off coefficient, in a fashion that will be more particularly described later, according to the current values of air intake manifold pressure or depression, engine cooling water temperature, engine revolution speed, and air flow speed in the air intake manifold. These two coefficients will be used in the interrupt routine which will shortly be described. In fact, the wall adhere coefficient AWC is used for determining the amount of fuel that will adhere to the liquid fuel layer already present on the wall surfaces of the intake manifold and of the intake ports, out of the total amount of fuel which will be injected through the fuel injection valve 20; and the sucking off coefficient SOC is used for determining the amount of fuel that has been sucked off from said liquid fuel layer already present on the wall surfaces of the intake manifold and of the intake ports, out of the total amount of fuel which was present in said layer, between the time of the last pulse of fuel injection through the fuel injection valve 20, and the next such pulse. Then, after these calculations, the main routine of the electronic control computer 50 whose flow chart is shown in FIG. 5 loops back to substantially its beginning, to repeat this cycle of input and calculation.

Figure 6:
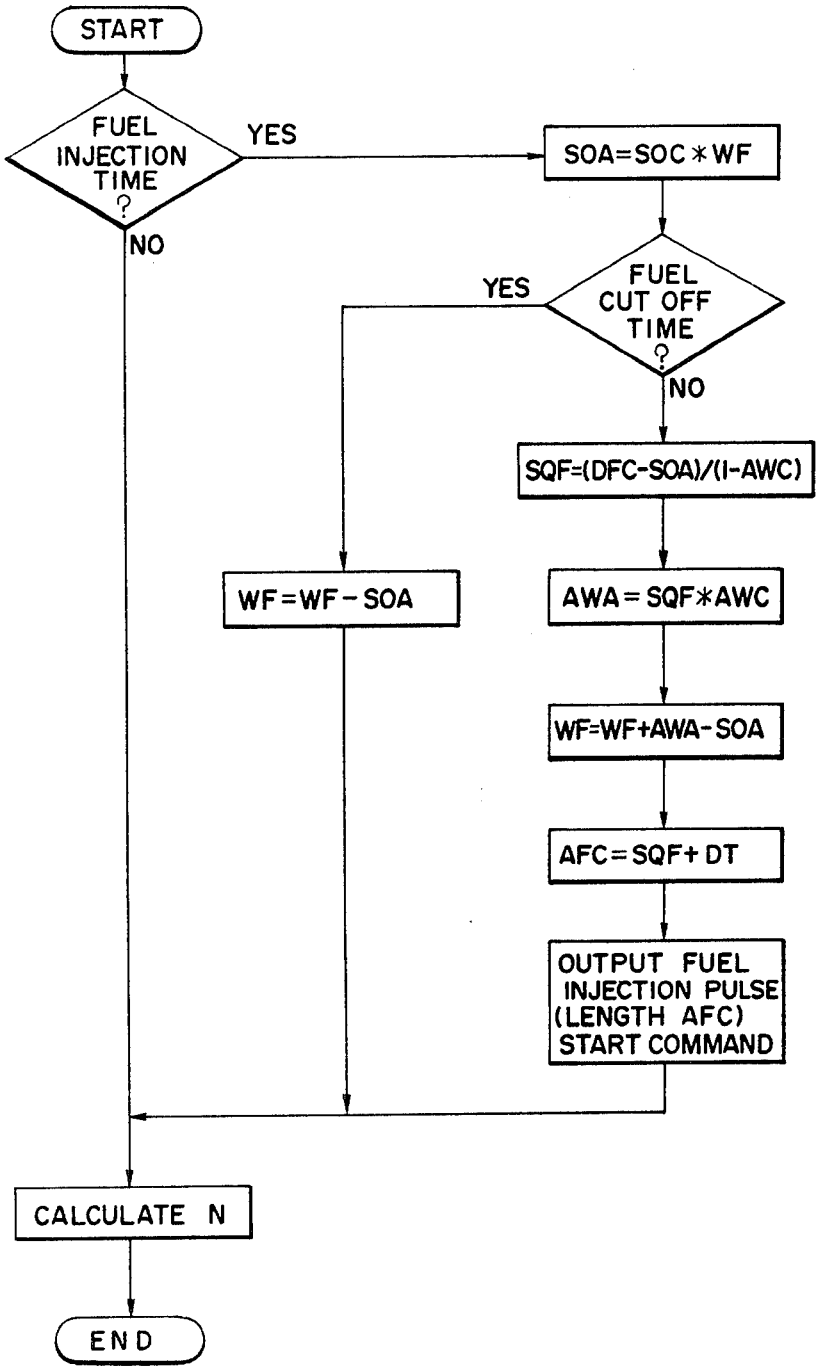
FIG. 6 is another flow chart, showing the overall flow of an interrupt routine which is executed repeatedly, according to an interrupt signal which is dispatched by a crank angle sensor, once every time the crankshaft of the engine rotates through an angle of 120° (for example), during the operation of said electronic computer which is incorporated in the preferred embodiment of the engine control device according to the present invention shown in FIGS. 1, 2, and 3, while said engine control device is practicing the preferred embodiment of the engine control method according to the present invention.

An interrupt routine of the electronic control computer 50, which will be detailed later with reference to the flow chart of FIG. 6, is executed whenever an interrupt signal is sent to the electronic control computer 50 from the distributor 27 by the crank angle sensor 29, which occurs at every 120°, for example, of crank angle rotation. In this interrupt routine, first, a decision is made as to whether at this particular interrupt instant it is the correct time to inject a pulse of liquid fuel into the inlet manifold 11 through the fuel injection valve 20, or not. If not, the interrupt routine skips and goes to its last stage. If, on the other hand, it is now the proper time to inject fuel, then the interrupt routine must handle two jobs. First, it must perform and update a predictive calculation of the amount of fuel WF that is adhering to the wall surfaces of the intake manifold and of the intake ports, and based upon this updated prediction it must decide on the correct amount of fuel injection SQF to be provided through the fuel injection valve 20 into the intake manifold which will be suitable for supplying the actual amount DFC of fuel desired to be introduced into the combustion chambers of the internal combustion engine 1, taking into account the fact that some of this amount SQF of injected fuel will be added to the layer of liquid fuel adhering to the wall surfaces (of amount WF), and that some of this layer of liquid fuel of amount WF will be sucked off into the combustion chambers by the air flow through the intake manifold. Second, if fuel injection is not currently being cut off, the interrupt routine must actually output a command, via the output interface circuit 56, to cause this amount SQF of fuel to be injected through the fuel injection valve 20. In fact, this first calculation job is slightly more difficult than has been simplistically outlined above, because the actual amount AWA of fuel which adheres to the layer of liquid fuel adhering to the wall surfaces (of amount WF), out of the total amount SQF of fuel injected through the fuel injection valve, in fact depends upon the amount SQF of fuel injected; and thus WF in fact also reciprocally depends on SQF, as wall as SQF being calculated from WF as detailed above. Hence the calculation has to be performed in a reverse manner, to take account of this mutual dependence, as will be more clearly explained later in the detailed explanation of the flow chart of this interrupt routine shown in FIG. 6.

Thus, if it is fuel injection time, first the interrupt routine makes a decision as to whether the present time is a so called fuel cut off time; in other words, as to whether the present time is a time of deceleration of the internal combustion engine 1 with the throttle valve 24 substantially fully closed, at which time it is proper to completely cease injection of liquid fuel through the fuel injection nozzle 20, in order to obtain maximum fuel economy of the internal combustion engine 1 during operation, and good quality of the exhaust gases of the internal combustion engine 1, as is per se well known with regard to the operation of various fuel injection systems. If it is not thus at the present time proper to cut off the fuel supply, then in order to derive the final result required, which is the value of a variable AFC which is the actual time that it is proper to order the fuel injection valve 20 to be opened, the interrupt routine performs the following calculations. First, the amount SOA of fuel that has been sucked off the wall surfaces of the intake manifold and the intake ports since the last fuel injection time instant is calculated, as being equal to the above detailed sucking off coefficient SOC multiplied by the actual amount WF of fuel that was adhering to the wall surfaces. Next, from the already known value of the desired amount DFC of fuel to be supplied to the combustion chambers 5 of the internal combustion engine 1, and from the already known values of the wall adhering coefficient AWC and the sucked off fuel amount SOA, (all of these values having been determined as explained above during the operation of the main routine whose flow chart is shown in FIG. 5), and using the formula $SQF=(DFC-SOA)/(1-AWC)$ which as will be explained later is appropriate in view of the reciprocal or mutual dependency of WF and SQF as outlined above, the amount of fuel to be squirted in through the fuel injection valve 20 is calculated by the interrupt routine. From this value SQF of the amount of fuel to be injected, the value AWA of the amount of fuel out of this injected amount that will adhere to the wall surfaces of the intake manifold and the intake ports is calculated as being equal to the above detailed wall adhere coefficient AWC multiplied by the actual amount SQF of fuel that is to be injected, and as is obviously correct the new value of the amount WF of fuel adhering to the wall surfaces is calculated as being equal to the old value of WF, plus AWA the adhere to the wall surfaces amount, minus SOA the sucked off fuel amount. Finally, the interrupt routine calculates the length of time AFC that the fuel injection valve 20 is to be opened as being equal to the amount SQF of fuel that is to be injected in through this fuel injection valve 20, plus a so called dead time DT for the fuel injection valve 20, and then outputs to the output interface circuit 56 this value AFC as a signal whose digital value is representative of the length of time that the fuel injection valve 20 is to be commanded to be opened. This signal as explained above, via a down counter, a flipflop, and an amplifier, or in some equivalent way, controls the fuel injection valve 20 to inject a pulse of gasoline and to be open for a time duration corresponding to the value AFC of this signal, starting immediately. Then finally, after this injection of a pulse of liquid fuel of amount SQF (or not, as the case may have been, according to the fuel cut off situation), just before its termination point, the interrupt routine calculates the latest value of N, the engine revolution speed, from the crank angle signal generated by the engine revolution sensor 29 fitted to the distributor 27, and from readings taken from a real time clock, a timer, or the like.

If, on the other hand, it is proper at the present time to cut off injected fuel supply, then this interrupt routine need not consider any contribution to the amount WF of fuel adhering to the walls of the intake passage and the intake ports from fuel injected through the fuel injection valve 20, since no fuel is to be injected; and also of course no question arises of outputting any command via the output interface circuit 56 to control the fuel injection valve 20. Thus, in this case, the interrupt routine merely calculates the amount SOA of fuel that has been sucked off the wall during the time between the last fuel injection pulse time and this fuel injection pulse time (at least this fuel injection pulse of course being a so called phantom fuel injection pulse, i.e. a fuel injection pulse injection of which is not actually made due to fuel cut off), and subtracts this amount SOA from the previous amount WF of fuel adhering to the wall surfaces so as to obtain the new or current value WF of fuel adhering to the wall surfaces, and then proceeds to its conclusion, wherein as before it calculates the latest value of N, the engine revolution speed, from the crank angle signal generated by the engine revolution sensor 29 fitted to the distributor 27.

Figure 5:
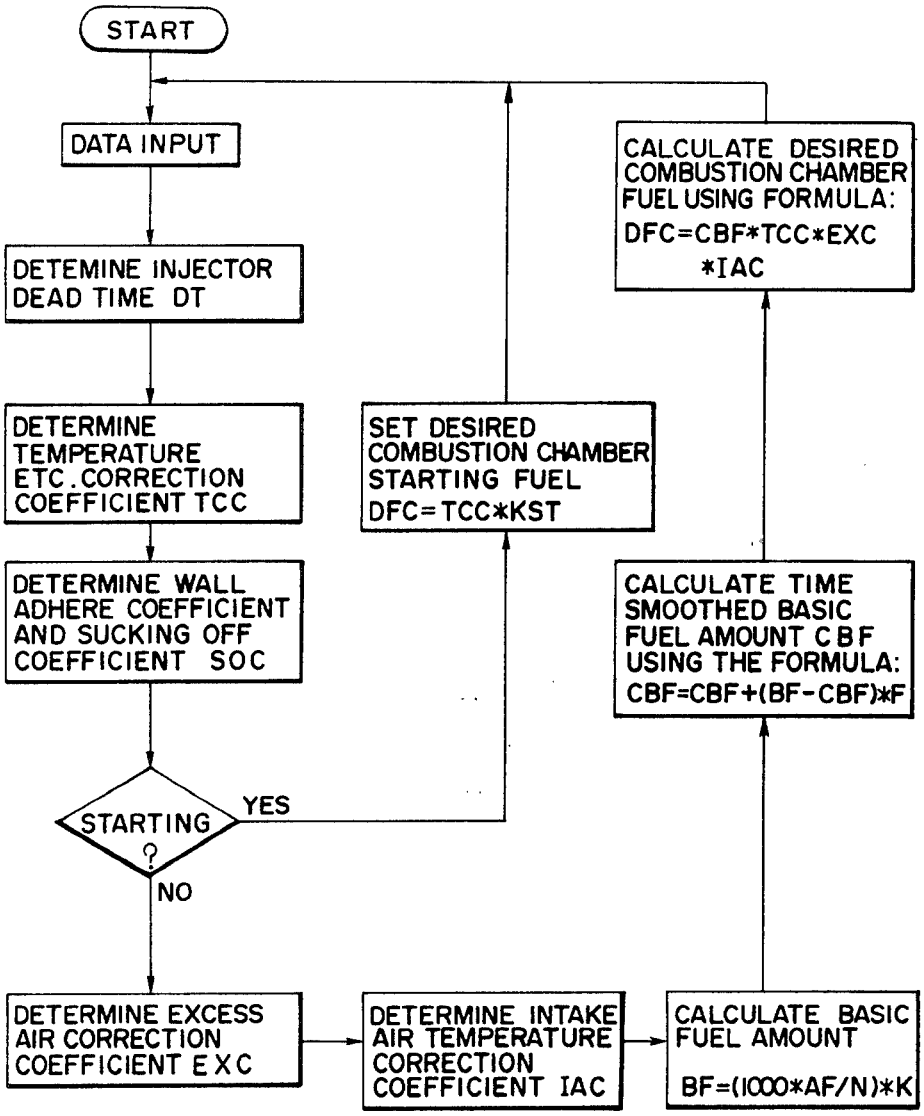
FIG. 5 is a flow chart, showing the overall control flow of a main routine which is repeatedly executed at a cycle time of about three milliseconds during the operation of said electronic computer which is incorporated in the preferred embodiment of the engine control device according to the present invention shown in FIGS. 1, 2, and 3 while said engine control device is practicing the preferred embodiment of the engine control method according to the present invention.

Although it is not particularly shown or explained in the flow charts of FIGS. 5 and 6, because it is not directly relevant to the present invention, the electronic control computer 50 also from time to time outputs a signal to the ignition coil of the internal combustion engine 1, again via an output device of a per se well known sort, so as to cause the ignition coil to produce an ignition spark at the appropriate time. The details of this particular function of the electronic control computer 50, again, will not particularly be described here because it is per se well known and conventional. Of course, the electronic control computer 50 could also perform various other control functions for the internal combustion engine 1, simultaneously in a time shared fashion; these of course are not shown particularly either.

Now the way of operation of the electronic control computer 50 will be explained in detail, with respect to the control computer program stored therein, which causes the preferred embodiment of the engine control method according to the present invention to be practiced by the preferred embodiment of the engine control device according to the present invention. This explanation will be made with the air of two flow charts of the control program stored therein, which are shown in FIGS. 5 and 6. In fact the actual control computer program of the electronic control computer 50 is written in a computer language, and an understanding of its intimate details is not necessary for understanding the principle of the present invention; many variations could be made without departing from the spirit of the present invention, and accordingly no more detail will be given of the computer program of the electronic control computer 50 in this preferred embodiment of the present invention than will be required by a person skilled in the art, who will be well able to fill in all the omitted detail if he or she requires to do so, based upon the disclosure contained herein.

GLOSSARY OF TERMS AND VARIABLES

In the following explanation, the values of various variables will be inputted to the RAM 53 of the electronic control computer 50, and the values of various other variables will be calculated. Thus, in order to make the following explanation clearer, the mnemonic names used herein to denote these variables will now be listed, along with a description of the function which the variables serve:

AF . . . the intake Air Flow amount as indicated by the intake air flow amount or rate sensor 37 fitted to the air flow meter 15 shown in FIGS. 1 and 2;

N . . . the engine revolution speed as calculated by the interrupt routine whose flow chart is shown in FIG. 6;

BF . . . the Basic amount of Fuel to be supplied into the combustion chambers 5 of the internal combustion engine 1, uncorrected for factors such as temperature, etc., and uncorrected for overshooting of the air flow meter 15;

K . . . a suitable constant relating to calculation of said Basic amount of Fuel BF when the internal combustion engine 1 is running under its own power, i.e. is not being started by cranking;

KST . . . another suitable constant relating to calculation of said Basic amount of Fuel BF when the internal combustion engine 1 is not running under its own power, i.e. is being started by cranking;

F . . . a suitable constant relating to time smoothing of the values of BF over successive iterations of a main routine of the electronic computer 50, according to the present invention;

CBF . . . the Basic amount of Fuel to be supplied into the combustion chambers 5 of the internal combustion engine 1, uncorrected for factors such as temperature, etc., but Corrected by time smoothing according to the present invention for overshooting of the air flow meter 15;

EXC . . . the Correction for the basic amount of fuel to be supplied into the combustion chambers 5 to allow for the amount of EXcess air in the exhaust manifold 17 as sensed by the O2 sensor 60;

TCC . . . the Correction Coefficient for the basic amount of fuel to be supplied into the combustion chambers 5 to allow for various factors such as cooling water Temperature and optionally other engine operational parameters;

IAC . . . the Correction Coefficient for the basic amount of fuel to be supplied into the combustion chambers 5 to allow for Intake Air temperature;

DFC . . . the Desired amount of Fuel to be supplied into the Combustion chambers 5 of the internal combustion engine 1 by the next pulse of fuel injection through the fuel injection valve 20;

WF . . . the total or cumulative amount of Fuel which is currently adhering to the Wall surfaces of the intake manifold 11 and the intake ports 6;

AWC . . . the Adhere to the Wall Coefficient, i.e. the proportion of the fuel injected through the fuel injection valve 20 in the next fuel injection pulse which will adhere to the wall surfaces of the intake manifold 11 and the intake ports 6;

AWA . . . the Adhere to the Wall Amount, i.e. the actual amount of the fuel injected through the fuel injection valve 20 in the next fuel injection pulse which will adhere to the wall surfaces of the intake manifold 11 and the intake ports 6;

SOC . . . the Sucking Off Coefficient, i.e. the proportion of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5;

SOA . . . the Sucking Off Amount, i.e. the actual amount of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5;

BAWC . . . the Basic value of the Adhere to the Wall Coefficient, i.e. the basic value of the proportion of the fuel injected through the fuel injection valve 20 in the next fuel injection pulse which will adhere to the wall surfaces of the intake manifold 11 and the intake ports 6, as exemplarily initially determined solely by reference to intake manifold pressure without any consideration of other engine operational parameters;

BSOC . . . the Basic value of the Sucking Off Coefficient, i.e. the basic value of the proportion of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5, as exemplarily initially determined solely by reference to intake manifold pressure without any consideration of other engine operational parameters;

AWW . . . a correction factor for the Adhere to the Wall coefficient AWC based upon the current value of engine cooling Water temperature as sensed by the cooling water temperature sensor 59 attached to the cylinder block 2;

SOW . . . a correction factor for the Sucking Off coefficient SOC based upon the current value of engine cooling Water temperature as sensed by the cooling water temperature sensor 59 attached to the cylinder block 2;

AWN . . . a correction factor for the Adhere to the Wall coefficient AWC based upon the current value of engine revolution speed N as sensed by the revolution sensor 29 fitted to the distributor 18;

SON . . . a correction factor for the Sucking Off coefficient SOC based upon the current value of engine revolution speed N as sensed by the revolution sensor 29 fitted to the distributor 18;

AWF . . . a correction factor for the Adhere to the Wall coefficient AWC based upon the current value of intake air Flow amount or rate as sensed by the intake air flow amount or rate sensor 37;

SOF . . . a correction factor for the Sucking Off coefficient SOC based upon the current value of intake air Flow amount or rate as sensed by the intake air flow amount or rate sensor 37;

SQF . . . the actual amount of Fuel Squirted in through the fuel injection valve 20 for this fuel injection pulse;

AFC . . . the time that the Fuel injection valve 20 is Actually Commanded by the CPU 51 to be opened; and DT . . . the Dead Time during which the fuel injection valve 20 is commanded to be opened by the CPU 51 but lags and does not actually inject fuel.

EXPLANATION OF THE MAIN ROUTINE FLOW CHART OF FIG. 5

FIG. 5 is a flow chart, showing the overall flow of a main routine which is repeatedly executed at a cycle time of about three milliseconds during the operation of the electronic control computer 50.

The flow of control of the electronic control computer 50 starts in the START block, when the internal combustion engine 1 is started up and the ignition circuit thereof is switched on, and in this START block the various flags and other variables of the program are initialized, as will be partially detailed later in this specification, when necessary for understanding. In particular the initial value of WF, the total or cumulative amount of fuel which is currently adhering to the wall surfaces of the intake manifold 11 and the intake ports 6, is set to zero, as is of course proper. Then the flow of control passes to enter next the DATA INPUT block.

In the DATA INPUT block, which is also the block back to which the flow of control returns at the end of the main routine which is being described, data is read into the electronic control computer 50, via the input interface circuit 55 and the A/D converter 54, relating to the current or latest values of the following engine operational parameters: (1) intake air temperature as sensed by the intake air temperature sensor 58 fitted in the air flow meter 15; (2) engine cooling water temperature as sensed by the cooling water temperature sensor 59 attached to the cylinder block 2; (3) excess air as sensed by the O2 sensor 60 fitted to the exhaust manifold 17; (4) throttle idling condition as sensed by the throttle idling limit switch 30; (5) intake air flow amount or rate as sensed by the intake air flow amount or rate sensor 37; and (6) the output voltage of the battery 48 of the vehicle. As will be seen later in the description of the flow chart of FIG. 6, which is the aforementioned interrupt routine which is performed every time the crankshaft of the internal combustion engine rotates by, for example, 120°, the calculation of the current value of the engine revolution speed N is performed in that interrupt routine, according to the crank angle and engine revolution speed signal which is generated by the aforementioned revolution sensor 29 fitted to the distributor 27 as input via the input interface circuit 55 and supplied to the electronic control computer 50; so this signal from the revolution sensor 29 is not processed in this DATA INPUT block; and nor is the signal from the standard position sensor 28 fitted to the distributor 27 processed in this DATA INPUT block, since this signal is primarily used for determining ignition timing (and will not be further particularly discussed in this specification, since it is not directly related to the inventive concept thereof). After the electronic computer 50 has performed the data input functions described above, the flow of control passes to enter next the DETERMINE INJECTOR DEAD TIME DT block.

In this DETERMINE INJECTOR DEAD TIME DT block, a value is determined by the electronic control computer 50 for DT, which is the dead time during which, when the fuel injection valve 20 is being commanded to be opened by the CPU 51, it will lag and not actually inject fuel. This dead time DT is determined from the digital value in the RAM 53 of the computer 50 representing the voltage currently being output by the battery 48 of the vehicle, according to some proper formula which will not be specifically explained here because it is not directly relevant to the present invention. Then, after the electronic computer 50 has performed the calculation described above, the flow of control passes to enter next the DETERMINE TEMPERATURE ETC. CORRECTION COEFFICIENT TCC block.

In the DETERMINE TEMPERATURE ETC. CORRECTION COEFFICIENT TCC block, a value TCC is derived as a correction coefficient to adjust the basic amount of fuel BF to be supplied to the combustion chambers 5 of the internal combustion engine 1 according to the current value of the temperature of the cooling water of the internal combustion engine 1, as measured by the cooling water temperature sensor 59. In fact, this water temperature correction coefficient may perform the function of correcting for progressive warming up of the internal combustion engine 1, and also the function of correcting for the just after starting condition of the internal combustion engine 1, i.e. the stone cold condition thereof. Various methods are already well known in the art for performing this derivation of such a correction factor as TCC, and therefore this calculation will not particularly be further described here. For example, table look up may be used. The factor TCC is represented as a multiplicatory correction factor, i.e. as the ratio of the desired supplied fuel amount to the present value of this supplied fuel amount, and thus in general is either a little greater than or a little less than unity. After the electronic computer 50 has performed the determination of TCC described above, the flow of control passes to enter next the DETERMINE WALL ADHERE COEFFICIENT AWC AND SUCKING OFF COEFFICIENT SOC block.

In the DETERMINE WALL ADHERE COEFFICIENT AWC AND SUCKING OFF COEFFICIENT SOC block, a value is determined according to some process for the adhere to the wall coefficient AWC, i.e. for the coefficient for calculating the proportion of the fuel injected through the fuel injection valve 20 in the next fuel injection pulse which will adhere to the wall surfaces of the intake manifold 11 and the intake ports 6, joining the fuel layer which is already adhered thereto; and a value is also determined according to some process for the sucking off coefficient SOC, i.e. for the coefficient for calculating the proportion of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5. As explained in the portion of this specification entitled "SUMMARY OF THE INVENTION", it has been determined by experimental researches that it is proper to represent these concepts as simple multiplicatory coefficients, to a first approximation. In fact, this derivation may be performed in a subroutine of this main routine, although it is not particularly so shown in the flow charts of FIG. 5. The value of the wall adhere coefficient AWC may be of approximately the order of a few tens of percent or so, but the value of the sucking off coefficient SOC may be of the order of a few percent, i.e. is typically much smaller than the value of the wall adhere coefficient AWC, about a tenth or so thereof. Thus, very approximately, in a steady state situation in which per each fuel injection pulse the amount of fuel which is added to the layer of fuel adhering to the wall surfaces of the intake manifold 11 and of the intake ports 6 is approximately equal to the amount of fuel sucked off from said layer, the total amount of fuel in said layer is typically of the order of ten times the amount of fuel injected in a single fuel injection pulse. Further, however, in a situation in which the total amount of fuel in said layer is substantially less than ten times the amount of fuel injected in a single fuel injection pulse, per each fuel injection pulse the amount of fuel which is added to the layer of fuel adhering to the wall surfaces of the intake manifold 11 and of the intake ports 6 is greater than the amount of fuel sucked off from said layer, and so the amount of fuel in this layer of fuel increases. Yet further, however, in a situation in which the total amount of fuel in said layer is substantially greater than ten times the amount of fuel injected in a single fuel injection pulse, per each fuel injection pulse the amount of fuel which is added to the layer of fuel adhering to the wall surfaces of the intake manifold 11 and of the intake ports 6 is less than the amount of fuel sucked off from said layer, and so the amount of fuel in this layer of fuel decreases.

The derivation of the adhere to the wall coefficient AWC, and the sucking off coefficient SOC may exemplarily be performed as follows, based upon the results of the aforementioned experiments which have been performed.

First, the basic value BAWC of the adhere to the wall coefficient AWC is determined, according to this example according to the current value of intake manifold pressure within the intake manifold 11 or the surge tank 12 as measured by an intake manifold pressure sensor not particularly shown in the figures, from a table, in which values of intake manifold pressure (corresponding to increasing engine load) are listed against basic values of the adhere to the wall coefficient AWC, and similarly the basic value BSOC of the sucking off coefficient SOC is also determined from a table, in which again values of intake manifold pressure (corresponding to increasing engine load) are listed against basic values of the sucking off coefficient SOC. In fact, the basic value BAWC of the adhere to the wall coefficient AWC is of the order of a few tens of percent, and increases as the intake manifold pressure increases, and the basic value BSOC of the sucking off coefficient SOC is of the order of a few percent, and similarly increases as the intake manifold pressure increases.

Next, a correction factor AWW for the basic adhere to the wall coefficient BAWC is determined according to the temperature of the cooling water of the internal combustion engine 1 from a table in which values of said correction factor AWW are listed against values of engine cooling water temperature, and similarly the value of a correction factor SOW for the basic sucking off coefficient BSOC according to the temperature of the cooling water of the internal combustion engine 1 is also determined from another table in which values of said correction factor SOW are similarly listed against values of engine cooling water temperature. In fact, the value of the correction factor AWW for the basic adhere to the wall coefficient BAWC in terms of engine cooling water temperature is of the order of unity, and decreases as the engine cooling water temperature increases, and the value of the correction factor SOW for the basic sucking off coefficient BSOC is also of the order of unity, but contrarily increases as the engine cooling water temperature increases.

Next, a correction factor AWN for the basic adhere to the wall coefficient BAWC is determined according to the revolution speed N of the internal combustion enginge 1 from a table in which values of said correction factor AWN are listed against values of engine revolution speed N, and similarly the value of a correction factor SON for the basic sucking off coefficient BSOC according to the revolution speed N of the internal combustion engine 1 is also detetermined from another table in which values of said correction factor SON are similarly listed against values of engine revolution speed N. In fact, the value of the correction factor AWN for the basic adhere to the wall coefficient BAWC in terms of engine revolution speed N is of the order of unity, and decreases as the engine revolution speed N increases, and the value of the correction factor SON for the basic sucking off coefficient BSOC is also of the order of unity, but contrarily increases as the engine revolution speed N increases.

Next, a correction factor AWF for the basic adhere to the wall coefficient BAWC is determined according to the intake air flow speed of the internal combustion engine 1 from a table in which values of said correction factor AWF are listed against values of engine intake air flow speed, and similarly the value of a correction factor SOF for the basic sucking off coefficient BSOC according to the intake air flow speed of the internal combustion engine 1 is also determined from another table in which values of said correction factor SOF are similarly listed against values of engine intake air flow speed. In fact, the value of the correction factor AWF for the basic adhere to the wall coefficient BAWC in terms of engine intake air flow speed is of the order of unity, and decreases as the engine intake air flow speed increases, and the value of the correction factor SOF for the basic sucking off coefficient BSOC is also of the order of unity, but contrarily increases as the engine intake air flow speed increases.

After the basic values BAWC and BSOC for the adhere to the wall coefficient AWC and for the sucking off coefficient SOC and these various correction factors therefor have been found, the final or adjusted values of said adhere to the wall coefficient AWC and for the sucking off coefficient SOC are derived therefrom by multiplying the basic value BAWC for the adhere to the wall coefficient by the values of all three of its correction factors, and by multiplying the basic value BSOC for the sucking off coefficient SOC by the values of all three of its correction factors; in other words, according to the following equations:

$$AWC=BAWC*AWW*AWN*AWF$$

and $$SOC=BSOC*SOW*SON*SOF$$

After the electronic computer 50 has performed, in this DETERMINE WALL ADHERE COEFFICIENT AWC AND SUCKING OFF COEFFICIENT SOC block, the determination of the wall adhere coefficient AWC and the sucking off coefficient SOC described above, or some similar derivation, the flow of control passes to enter next the STARTING? decision block.

In the STARTING? decision block, a decision is made as to whether the internal combustion engine 1 is currently actually running under its own power, or not, i.e. as to whether the internal combustion engine is being cranked or not. In fact, this decision is made according to whether the revolution speed N of the internal combustion engine 1, as determined by the interrupt routine whose flow chart is shown in FIG. 6 and wich will be described in detail later, is below a certain threshold value or not. This is a practical method because as a matter of practice the engine revolution speed when starting the internal combustion engine 1 by cranking is always much lower than any possible engine speed when the internal combustion engine 1 is running under its own power. Thus, this STARTING? decision block serves to decide whether a proper amount of fuel should be provided for the purposes of starting the internal combustion engine 1, or not. If the result of the decision in this STARTING? decision block is NO, i.e. if the internal combustion engine is currently operating under its own power, then the flow of control passes to enter next the DETERMINE EXCESS AIR CORRECTION COEFFICIENT EXC block, and otherwise if the result of the decision in this STARTING? decision block is YES, i.e. if the internal combustion engine 1 is currently being started (and has not yet fired up), then the flow of control passes to enter next the SET DESIRED COMBUSTION CHAMBER STARTING FUEL DFC=TCC*KST block.

Thus, in this YES branch from this STARTING? decision block, since it is decided at this point that the internal combustion engine 1 is being cranked and has not yet started, of course the current values of intake air flow and engine revolution speed are irrelevant to determining the amount of fuel to be supplied to the combustion chambers 5 of the internal combustion engine 1, since this amount of starting fuel should be determined according to temperature criteria only, in this implementation. Therefore at this point in the flow chart of FIG. 5 the flow of control passes to enter next the SET DESIRED COMBUSTION CHAMBER STARTING FUEL DFC=TCC*KST block.

In this SET DESIRED COMBUSTION CHAMBER STARTING FUEL DFC=TCC*KST block, the value of DFC, which is desired amount of fuel to be supplied into the combustion chambers 5 of the internal combustion engine 1 by the next pulse of fuel injection through the fuel injection valve 20, is set to be equal to TCC, the correction coefficient calculated as explained above for the basic amount of fuel to be supplied into the combustion chambers 5 to allow for various factors such as cooling water temperature and optionally other engine operational parameters, multiplied by KST, which is a suitable constant for this purpose. This derivation of the amount of fuel to be supplied to the combustion chambers 5 of the internal combustion engine 1 during starting of the internal combustion engine 1 has been found to be adequate. Thus, when it is time for fuel injection, as will be seen later the interrupt routine whose flow chart is shown in FIG. 6 causes such an amount SQF of fuel to be squirted in through the fuel injection valve 20 as to cause this desired fuel amount DFC of fuel to be supplied to the combustion chambers 5 of the internal combustion engine 1. From this SET DESIRED COMBUSTION CHAMBER STARTING FUEL DFC=TCC*KST block, the flow of control of this main routine whose flow chart is shown in FIG. 5 for the electronic control computer 50 returns to enter next the DATA INPUT block, at substantially the beginning of this main routine again, and repeats the cycle described, since said main routine has completed its job, in this engine starting case, of calculating DT the dead time during which the fuel injection valve 20 is commanded to be opened by the CPU 51 but lags and does not actually inject fuel, DFC the desired amount of fuel to be supplied into the combustion chambers 5 of the internal combustion engine 1 by the next pulse of fuel injection through the fuel injection valve 20, AWC the adhere to the wall coefficient, i.e. the proportion of the fuel injected through the fuel injection valve 20 in the next fuel injection pulse which will adhere to the wall surfaces of the intake manifold 11 and the intake ports 6, and SOC the sucking off coefficient, i.e. the proportion of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5.

On the other hand, in the NO branch from this STARTING? decision block, since it is decided at this point that the internal combustion engine 1 is running under its own power, and therefore at this point full calculation of the amount of fuel to be supplied to the combustion chambers 5 of the internal combustion engine 1 should be made, including various correction factors, therefore the flow of control passes to enter next the DETERMINE EXCESS AIR CORRECTION COEFFICIENT EXC block.

In this DETERMINE EXCESS AIR CORRECTION COEFFICIENT EXC block, a value EXC is derived as an exhaust gas air/fuel ratio correction factor to adjust the basic amount BF of fuel to be supplied to the combustion chambers 5 of the internal combustion engine 1 according to the current value of the excess air signal dispatched from the oxygen sensor 60 representing the air/fuel ratio of the exhaust gases in the exhaust manifold 17. This value EXC is so adjusted from time to time as to cause the air/fuel ratio in the exhaust manifold 17, over a period of time, to home in on the stoichiometric value by a feedback process, as already outlined in the section of this specification entitled "BACKGROUND OF THE INVENTION". Various methods are, again, already well known in the art for performing this derivation of such an air/fuel ratio correction factor or excess air correction coefficient as EXC, and for managing this homing in process, and therefore this calculation will not particularly be further described here. For example, again table look up may be used. The factor EXC is again represented as a multiplicatory correction factor, i.e. as the ratio of the desired supplied fuel amount to the present value of this supplied fuel amount, and thus in general is again either a little greater than or a little less than unity. After the electronic computer 50 has performed the derivation of EXC in this DETERMINE EXCESS AIR CORRECTION COEFFICIENT EXC block, the flow of control passes to enter next the DETERMINE INTAKE AIR TEMPERATURE CORRECTION COEFFICIENT IAC block.

In this DETERMINE INTAKE AIR TEMPERATURE CORRECTION COEFFICIENT IAC block, the value of IAC, which is the correction coefficient for the basic amount of fuel to be supplied into the combustion chambers 5 to allow for intake air temperature, is calculated according to the current value of intake air temperature, as sensed by the intake air temperature sensor 58 and inputted into the RAM 53 of the electronic control computer 50 via the A/D converter 54. Again, this correction coefficient IAC may be calculated by table look up, for example. From this DETERMINE INTAKE AIR TEMPERATURE CORRECTION COEFFICIENT IAC block, the flow of control passes to enter next the CALCULATE BASIC FUEL AMOUNT BF=1000* AF/N)*K block.

Figure 7A:
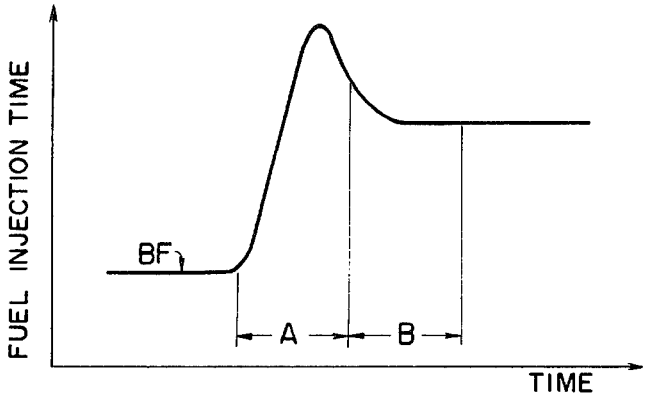
FIG. 7*a* is a time chart, in which fuel injection time or corresponding amount of fuel is shown on the ordinate and time is shown on the abscissa, showing the variation with respect to time of a value BF representing the basic desired amount of fuel to be supplied into the combustion chambers of the internal combustion engine by the next pulse of fuel injection through the fuel injection valve, during an engine operational episode in which first the engine is being operated in a steady operational mode at a relatively low engine load level, then subsequently the engine is accelerated quite sharply, and then subsequently the engine is operated in a steady operational mode at a higher load level; this figure showing that during steady operation of the engine the value BF representing the basic desired amount of fuel to be supplied is steady, but that during acceleration of the engine this value BF representing the basic desired amount of fuel to be supplied increases very sharply, having a high spike quite early in the acceleration episode, due to the above mentioned overshooting of the flapper valve incorporated in the aforesaid intake air flow meter.

In the CALCULATE BASIC FUEL AMOUNT BF=(1000* AF/N)*K block, the basic amount of fuel to be supplied into the combustion chambers 5 of the internal combustion engine 1 is calculated from the current value of AF the intake air flow amount as indicated by the intake air flow amount or rate sensor 37 fitted to the air flow meter 15 shown in FIGS. 1 and 2, and from the current value of N, which is the current value of engine revolution speed as calculated by the interrupt routine whose flow chart is shown in FIG. 6, as will be explained later. This calculation is performed according to the formula, per se well known in the art with relation to this L-jetronic system method of fuel injection, of BF=(1000*AF/N)*K, where the symbol K represents a suitable constant, and where the symbol BF represents the basic amount of fuel to be supplied into the combustion chambers 5 of the internal combustion engine 1, uncorrected for factors such as engine cooling water temperature, exhaust gas quality, etc., and uncorrected for the temperature of intake air. In FIG. 7*a* there is shown a time chart, in which fuel injection time or corresponding amount of fuel is shown on the ordinate and time is shown on the abscissa, showing the variation with respect to time of this value BF representing the basic desired amount of fuel to be supplied into the combustion chambers of the internal combustion engine by the next pulse of fuel injection through the fuel injection valve, during an engine operational episode in which first the engine is being operated in a steady operational mode at a relatively low engine load level, then subsequently the engine is accelerated quite sharply, and then subsequently the engine is operated in a steady operational mode at a higher load level. This figure shows that during steady operation of the engine the value BF representing the basic desired amount of fuel to be supplied is steady, but that during acceleration of the engine this value BF representing the basic desired amount of fuel to be supplied increases very sharply, having a high spike quite early in the acceleration episode, due to the above mentioned overshooting of the flapper valve incorporated in the aforesaid intake air flow meter. The region designated by the symbol A in this figure is the time region just after the start of acceleration when there is a danger, according to prior art engine control concepts, of the occurrence of a rich spike in the air/fuel ratio of the air-fuel mixture supplied to the combustion chambers 5 of the internal combustion engine 1 due to overshooting of the air flow meter 15, and the region designated by the symbol B in this figure is the time region somewhat after this first time region A when there is a danger, according to prior art engine control concepts, of the occurrence of a lean spike in the air/fuel ratio of the air-fuel mixture supplied to the combustion chambers 5 of the internal combustion engine 1 due to adhering of injected fuel to the walls of the intake manifold 11 and of the intake ports 6 of the internal combustion engine 1. In any case, after the electronic computer 50 has performed the calculation described above, the flow of control passes to enter next the CALCULATE TIME SMOOTHED BASIC FUEL AMOUNT CBF block.

In this CALCULATE TIME SMOOTHED BASIC FUEL AMOUNT CBF block, the value of the variable CBF, the basic amount of fuel to be supplied into the combustion chambers 5 of the internal combustion engine 1, as yet uncorrected for factors such as temperature, etc., but corrected by time smoothing according to the present invention for overshooting of the air flow meter 15, is calculated from the value of BF, the basic amount of fuel to be supplied to the combustion chambers 5 as calculated at this time, by a process of time smoothing over successive iterations of this main routine whose flow chart is being explained, according to the equation:

$$CBF=CBF+(BF-CBF)*F$$

Here F is a suitable constant, of fairly small value. Thus, as will be easily understood, as the main routine whose flow chart is shown in FIG. 5 is repeatedly performed, the value of CBF pursues the value of BF in a smoothed fashion, and whenever the value of BF remains static the value of CBF quickly becomes substantially equal thereto, after a characteristic number of iterations or repetitions of the main routine which is determined by the reciprocal of the constant F. The value of this constant F should be suitably determined according to the operational characteristics of the air flow meter 15; a proper value for the shown flapper type of air flow meter 15 may be about 0.025, thus causing the characteristic time value for time smoothing to be about the time taken for 1/0.025 executions of this main routine whose flow chart is shown in FIG. 5, i.e. the time taken for about forty such repetitions, i.e. about 0.12 seconds, which is a characteristic time interval value for oscillation of the air flow meter 15, i.e. for overshooting thereof. Generally speaking, the constant F may be in the range below about 0.1, thus determining this characteristic number of iterations of the main routine whose flow chart is shown in FIG. 5 at more than about ten.

Figure 7B:
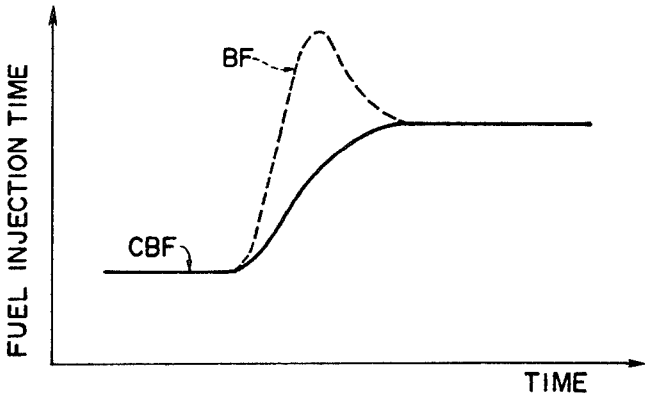
FIG. 7*b* is a time chart, in which fuel injection time or corresponding amount of fuel is shown on the ordinate and time is shown on the abscissa, said abscissa corresponding to and indicating the same times as the abscissa of FIG. 7*a*, illustrating the same engine accelerational operational episode as the episode illustrated in FIG. 7*a*, showing by the dashed line the aforesaid variation of the value BF representing the basic desired amount of fuel to be supplied into the combustion chambers of the internal combustion engine by the next pulse of fuel injection through the fuel injection valve, and also showing by the solid line the variation with respect to time of a corrected value CBF of this value BF representing the basic desired amount of fuel to be supplied into the combustion chambers of the internal combustion engine by the next pulse of fuel injection through the fuel injection valve, said corrected value CBF being produced by a time smoothing process which will be described later in this specification; this time chart showing that this corrected value CBF during acceleration undergoes no high spike at all.
Figure 7C:
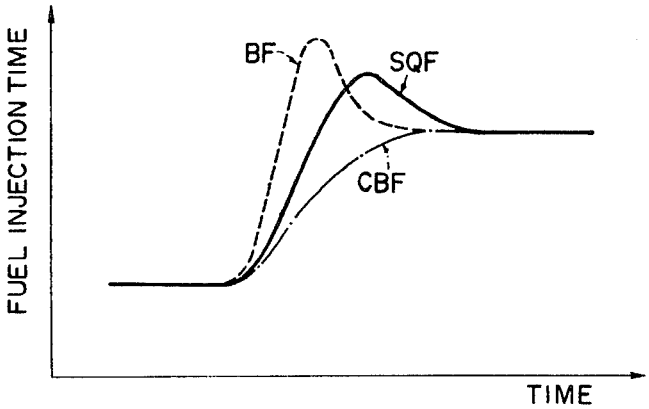
FIG. 7*c* is a time chart, in which fuel injection time or corresponding amount of fuel is shown on the ordinate and time is shown on the abscissa, said abscissa corresponding to and indicating the same times as the abscissas of FIG. 7*a* and FIG. 7*b*, illustrating the same engine accelerational operational episode as the episode illustrated in FIGS. 7*a* and 7*b*, showing by the dashed line the aforesaid variation of the value BF representing the basic desired amount of fuel to be supplied into the combustion chambers of the internal combustion engine by the next pulse of fuel injection through the fuel injection valve, showing by the single dotted line the aforesaid variation of the value CBF which is the corrected or time smoothed value of the aforesaid value BF representing said basic desired amount of fuel to be supplied, and showing by the solid line the variation of a value SQF representing the total or cumulative amount of fuel which is actually to be injected through the fuel injection valve in order to supply an amount of fuel represented by this smoothed value CBF to the combustion chambers of the internal combustion engine, taking account of the amount of fuel which adheres to the wall surfaces of the intake manifold and of the intake ports of the engine; this figure showing that during steady operation of the internal combustion engine this value SQF representing the actual fuel injection amount is substantially equal to the corrected value CBF of the value BF representing the basic desired amount of fuel to be supplied, but that during acceleration of the engine the value SQF representing the total or cumulative amount of fuel which is actually to be injected through the fuel injection valve rises quite significantly above the corrected value CBF of the value BF representing the basic desired amount of fuel to be supplied to the combustion chambers, at a somewhat later time in the engine accelerational operational episode than the above mentioned high spike in the basic value BF of desired fuel to be supplied, in order to allow for increasing adhering amount of fuel on the wall surfaces of the intake manifold and the intake ports of the internal combustion engine.

The pursuit behavior of the value of CBF is illustrated in FIG. 7*b*, which is a time chart in which fuel injection time or corresponding amount of fuel is shown on the ordinate and time is shown on the abscissa, said abscissa corresponding to and indicating the same times as the abscissa of FIG. 7*a*, and illustrating the same engine accelerational operational episode as the episode illustrated in FIG. 7*a*. In this chart the dashed line shows the aforesaid variation of the value BF representing the basic desired amount of fuel to be supplied into the combustion chambers of the internal combustion engine 1 by the next pulse of fuel injection through the fuel injection valve 20, and the solid line shows the variation with respect to time of the corrected and time smoothed value CBF of this value BF representing the basic desired amount of fuel to be supplied into the combustion chambers of the internal combustion engine by the next pulse of fuel injection through the fuel injection valve. This time chart shows that this corrected value CBF during acceleration undergoes no high spike at all. In any case, after this CALCULATE TIME SMOOTHED BASIC FUEL AMOUNT CBF block, control passes next to enter the CALCULATE DE- SIRED COMBUSTION CHAMBER FUEL DFC=CBF*TCC*EXC*IAC block.

In this CALCULATE DESIRED COMBUSTION CHAMBER FUEL DFC=CBF*TCC*EXC*IAC block, the amount DFC of fuel which is proper to be introduced into the combustion chambers 5 of the internal combustion engine 1 is calculated according to the value of CBF the basic amount of fuel to be supplied into the combustion chambers 5 of the internal combustion engine 1, uncorrected for factors such as temperature, etc., but corrected according to the present invention for overshooting of the air flow meter 15, and according to these three adjustment or correction factors TCC, EXC, and IAC that have been calculated, by multiplying the basic amount of fuel BF that is desired to be supplied into said combustion chambers by the temperature correction factor TCC that has already been determined, by the air/fuel ratio correction factor or excess air correction coefficient EXC that has already been determined, and by the intake air temperature correction coefficient IAC that has already been determined. Thus, when it is time for fuel injection, as will be seen later the interrupt routine whose flow chart is shown in FIG. 6 causes such an amount SQF of fuel to be squirted in through the fuel injection valve 20 as to cause this desired fuel amount DFC of fuel to be supplied to the combustion chambers 5 of the internal combustion engine 1.

After this CALCULATE DESIRED COMBUSTION CHAMBER FUEL DFC=CBF*TCC*EXC*IAC block, the flow of control of this main routine whose flow chart is shown in FIG. 5 for the electronic control computer 50 returns to enter next the DATA INPUT block, at substantially the beginning of this main routine again, and repeats the cycle described, since said main routine has completed its job of calculating DT the dead time during which the fuel injection valve 20 is commanded to be opened by the CPU 51 but lags and does not actually inject fuel, DFC the desired amount of fuel to be supplied into the combustion chambers 5 of the internal combustion engine 1 by the next pulse of fuel injection through the fuel injection valve 20, AWC the adhere to the wall coefficient, i.e. the proportion of the fuel injected through the fuel injection valve 20 in the next fuel injection pulse which will adhere to the wall surfaces of the intake manifold 11 and the intake ports 6, and SOC the sucking off coefficient, i.e. the proportion of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5.

It should be particularly noted that actual outputting of a digital value which causes the desired amount SQF (to be explained later) of fuel to be injected through the fuel injection valve 20, i.e. actual initiation of a pulse of fuel injection through the fuel injection valve 20, never occurs during the time that the electronic computer 50 is executing any part of the cycle of this main routine whose flow chart is shown in FIG. 5; the timing of this main routine is not particularly fixed, although typically it may take about three milliseconds to execute, as stated above. The actual command for starting of a pulse of injection of fuel through the fuel injection valve 20 is given by the electronic computer 50 while executing the interrupt routine whose flow chart is shown in FIG. 6, which will be explained later, and which is performed for every 120°, for example, of crank angle, according to an interrupt signal dispatched from the revolution sensor 29 fitted to the distributor 27.

EXPLANATION OF THE INTERRUPT ROUTINE FLOW CHART OF FIG. 6

FIG. 6 is another partial flow chart, showing the overall flow of an interrupt routine which is executed repeatedly, once every time the crankshaft of the engine rotates through an angle of 120°, for example, during the operation of said electronic computer which is incorporated in the preferred embodiment of the engine control device according to the present invention shown in FIGS. 1, 2, and 3 while said engine control device is practicing the preferred embodiment of the engine control method according to the present invention. The performance of the computer program which is currently being executed by the electronic computer 50, which may well be the main routine whose flow chart is given in FIG. 5, is interrupted every time a crank angle signal is received by the input interface circuit 55 from the crank angle sensor 29 fitted to the distributor 27, and the computer program of FIG. 6 is then immediately preferentially executed instead.

The electronic computer 50, during the execution of this interrupt routine, performs in sequence several distinct functions. First, it decides whether or not it is currently a time for injecting a pulse of fuel of suitable duration and amount through the fuel injection valve 20 to provide an amount of fuel determined by the current value of DFC into the combustion chambers 5 of the internal combustion engine 1 during the next engine cycle, and if this is not the case then the flow of control skips directly to the last stage of this interrupt routine, i.e. to the stage which calculates the up to date value of engine revolution speed N as explained later. On the other hand, if it is now fuel injection time, then the electronic computer 50 in any case will definitely be required to update the value WF which represents the amount of fuel present in the film of liquid fuel adhered to the wall surfaces of the intake manifold and the intake valves, and accordingly the sucked off amount SOA of this fuel which has been sucked off from these wall surfaces since the last fuel injection pulse is calculated. Then, the electronic computer 50 makes a decision as to whether it is currently time to cut off the injection of fuel through the fuel injection valve 20, i.e. as to whether it is currently a time of deceleration with the throttle of the internal combustion engine 1 fully closed. If it is such a fuel cut off time, then the electronic computer 50 just updates the value of the amount WF of fuel present in the film of liquid fuel adhered to the wall surfaces by subtracting from it the just recently calculated value of the sucked off amount SOA of this fuel, and then proceeds to the last stage of this interrupt routine. On the other hand, if it is not such a fuel cut off time, then the electronic computer 50 calculates the proper value of the amount SQF of fuel that should be injected in a squirt through the fuel injection valve 20 in this upcoming fuel injection pulse, in order for the desired amount DFC of fuel to be supplied to the combustion chambers 5 of the internal combustion engine 1 in the next engine cycle, bearing in mind the amount of this upcoming pulse of squirted in fuel that will adhere to the wall surfaces of the intake manifold 11 and the intake ports 6, and also bearing in mind the amount of fuel that was adhered to these wall surfaces that is sucked off said wall surfaces by the air flow passing these surfaces, already calculated. Then, the electronic computer 50 adds to the time of opening of the fuel injection valve 20 representing this amount SQF of fuel to be injected the time DT representing the so called dead time of the fuel injection valve, i.e. its operational lag, which was calculated during the last pass through the main routine whose flow chart is shown in FIG. 5, to produce a value AFC, and next the electronic computer 50 outputs a command to commence said fuel injection pulse of duration determined by the current value of AFC. Finally, the electronic computer 50 calculates the current value N of engine revolution speed.

The flow of control of the electronic control computer 50, in this interrupt routine of FIG. 4, starts by transiting into the FUEL INJECTION TIME? decision block.

In the FUEL INJECTION TIME? decision block, a decision is made as to whether the present crank angle interrupt, which has occurred because the event has occurred that the crankshaft of the internal combustion engine 1 has turned through 120°, for example, of crank angle from the last such interrupt, i.e. that the crankshaft of the internal combustion engine 1 has reached the next one of three points in the crank angle diagram which are spaced apart from one another, in this example, by angles of 120° around said crank angle diagram (such as, for example, the points 120°, 240°, and 360°, or the like, according to the particular construction of the distributor 27 and of the crank angle sensor 29), is an interrupt at which a pulse of fuel (of duration and amount corresponding to the current value of AFC, as will be seen later) should be injected into the intake manifold 11 of the internal combustion engine 1 through the fuel injection valve 20, or not. The meaning of this test is that, depending upon the particular construction of the fuel injection system of the internal combustion engine 1, fuel injection may be designed to occur once per crankshaft revolution, or possibly once per two crankshaft revolutions, or at some other occurrence frequency. In any case, the time between the starting instants of successive pulses of fuel injection should be an integral multiple of the time between successive computer interrupts caused by the crankshaft rotating through 120°, as exemplarily taken, i.e., in this example, successive pulses of fuel injection should start at points in the crank angle diagram spaced apart by angles which are some multiple of 120°. Thus, this FUEL INJECTION TIME? decision block serves to decide wether this particular interrupt is in fact a fuel injection interrupt. This decision can be based upon, for example, counting upwards in a counter which is reset at the start of every fuel injection pulse, or the like; the details will easily be completed by one of ordinary skill in the computer art, based upon the disclosure herein. If the result of the decision in this FUEL INJECTION TIME? decision block is YES, i.e. if this particular interrupt is in fact a fuel injection interrupt, then the flow of control passes to enter next the SOA=SOC*WF block, and otherwise if the result of the decision in this FUEL INJECTION TIME? decision block is NO, i.e. if this particular interrupt is in fact not a fuel injection interrupt, then the flow of control passes to enter next the CALCULATE N block.

Thus, in this NO branch from this FUEL INJECTION TIME? decision block, since it is decided at this point that this particular interrupt is in fact not a fuel injection interrupt, then the flow of control skips to the end of this interrupt routine, or rather to the last function to be executed thereby in said CALCULATE N block.

On the other hand, in the YES branch from this FUEL INJECTION TIME? decision block, it is decided at this point that this particular interrupt is in fact a fuel injection interrupt, and therefore at this point actual fuel injection should be initiated, providing as seen later that it is not time to cut off the injection of fuel. Thus, the flow of control passes to enter next the SOA=SOC*WF block.

In this SOA=SOC*WF block, since it is now decided that the present interrupt instant is a fuel injection type interrupt instant, which is as explained above a determined angle away in the crank angle diagram from the last fuel injection type interrupt instant, thus, whether fuel cut off is required to be performed or not, a certain amount of fuel will have been sucked off from the film of liquid fuel which is adhering to the side wall surfaces of the intake manifold 11 and the intake ports 6 since the last fuel injection type interrupt instant, and accordingly the value of the variable WF which represents the amount of fuel in said film of liquid fuel adhering to said wall surfaces must be updated. Therefore, in this SOA=SOC*WF block, the value is calculated of SOA the sucking off amount, i.e. of the actual amount of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5. This calculation is made by multiplying the total amount WF of fuel in said film of liquid fuel by SOC the sucking off coefficient, i.e. the proportion or ratio of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5. This sucking off coefficient SOC was calculated, as explained above, in the main routine of the electronic control computer 50 whose flow chart is shown in FIG. 5. From this SOA=SOC*WF block, the flow of control passes to enter next the FUEL CUT OFF TIME? decision block.

In the FUEL CUT OFF TIME? decision block, a decision is made as to whether it is currently time to cut off the injection of fuel through the fuel injection valve 20, i.e. as to whether it is currently a time of deceleration with the throttle of the internal combustion engine 1 fully closed. Thus, this FUEL CUT OFF TIME? decision block serves to decide whether actually fuel should be injected at this particular time or not. If the result of the decision in this FUEL CUT OFF TIME? decision block is NO, i.e. if fuel cut off is not to be performed at this time, then the flow of control passes to enter next the SQF=(DFC−SOA)/(1−AWC) block, and otherwise if the result of the decision in this FUEL CUT OFF TIME? decision block is YES, i.e. if at this time fuel cut off is to be performed so that actually no fuel is to be injected at this time, then the flow of control passes to enter next the WF=WF−SOA block.

In the NO branch from this FUEL CUT OFF TIME? decision block, since it is decided at this point that fuel cut off is not to be performed at this time, it is next necessary to calculate the actual amount of fuel to be injected through the fuel injection valve 20. Therefore, the flow of control passes to enter next the SQF=(DFC−SOA)/(1−AWC) block.

In this SQF=(DFC−SOA)/(1−AWC) block, the value of SQF, the actual amount of fuel to be squirted in through the fuel injection valve 20 for this fuel injection pulse, is set to the value (DFC−SOA)/(1−AWC), by calculation from the values of: DFC the desired amount of fuel to be supplied into the combustion chambers 5 of the internal combustion engine 1 by the next pulse of fuel injection through the fuel injection valve 20, which has been calculated in the last execution of the main routine of the electronic control computer 50 whose flow chart is shown in FIG. 5; of SOA the amount of the fuel adhering to the wall surfaces of the intake manifold 11 and the intake ports 6 after the last fuel injection pulse which will have been sucked off therefrom during the time period between said last fuel injection pulse and the current fuel injection pulse so as to be swept into the combustion chambers 5, which has just been calculated; and of AWC the adhere to the wall coefficient, i.e. the proportion of the fuel injected through the fuel injection valve 20 in the next fuel injection pulse which will adhere to the wall surfaces of the intake manifold 11 and the intake ports 6, which has been calculated in the last execution of the main routine of the electronic control computer 50 whose flow chart is shown in FIG. 5; all these values being already known values. The reason for the use of this particular formula for calculating SQF will be explained shortly; the formula has been determined according to the fact that, as explained later, the actual amount AWA of the fuel injected through the fuel injection valve 20 in the present fuel injection pulse which will adhere to the wall surfaces of the intake manifold 11 and the intake ports 6 naturally depends upon the amount SQF of squirted in fuel. From this SQF=(DFC−SOA)/(1−AWC) block, the flow of control passes to enter next the AWA=SQF*AWC block.

In this AWA=SQF*AWC block, the value is calculated of AWA the amount of the fuel injected through the fuel injection valve 20 in the present fuel injection pulse which will adhere to the wall surfaces of the intake manifold 11 and the intake ports 6, i.e. the amount of the fuel in the present fuel injection pulse of magnitude SQF which will not reach the combustion chambers 5, but which will be absorbed into the layer or film of fuel on said wall surfaces. This calculation is made by multiplying the total amount SQF of fuel to be squirted in through the fuel injection valve 20 for this fuel injection pulse by AWC the adhere to the wall coefficient, i.e. the proportion of the fuel injected through the fuel injection valve 20 in the next fuel injection pulse which will adhere to the wall surfaces of the intake manifold 11 and the intake ports 6. This adhere to the wall coefficient AWC was calculated, as explained above, in the last execution of the main routine of the electronic control computer 50 whose flow chart is shown in FIG. 5. From this AWA=SQF*AWC block, the flow of control passes to enter next the WF=WF+AWA−SOA block.

In this WF=WF+AWA−SOA block, the process is performed of updating the value of WF, the amount of fuel present in the film of fuel adhering to the wall surfaces of the intake manifold 11 and the intake ports 6, by adding thereto the amount AWA of fuel which will adhere thereto on this fuel injection pulse, and by then subtracting therefrom the value of SOA, the sucked off amount of fuel. Thus a cumulative calculation is made of this value WF of the amount of fuel present in the film of fuel adhering to the wall surfaces of the intake manifold 11 and the intake ports 6. From this WF=WF+AWA−SOA block, the flow of control passes to enter next the AFC=SQF+DT block.

At this point it is proper to verify that the above formula for determining SQF, which set the value of SQF to (DFC−SOA)/(1−AWC), in fact gives the correct amount of fuel supply to the combustion chambers 5 of the internal combustion engine 1. In fact, the amount of fuel which reaches the combustion chambers 5 is clearly equal to SQF−AWA+SOA, i.e. is equal to the amount of injected fuel, minus the amount of this injected fuel which will not reach the combustion chambers 5 because it is added to the adhered layer of liquid fuel on the wall surfaces of the intake manifold 11 and the intake ports 6, plus the amount of fuel which will have been sucked off these wall surfaces.

Thus, this amount of fuel which reaches the combustion chambers 5, substituting for AWA, is equal to:

$$SQF-SQF*AWC+SOA;$$

which rearranged equals:

$$SQF*(1-AWC)+SOA;$$

which, substituting for SQF, equals:

$$((DFC-SOA)*(1-AWC))/(1-AWC)+SOA;$$

which cancels out to DFC, which is in fact exactly the desired amount of fuel to be supplied into the combustion chambers 5 of the internal combustion engine 1 by the next pulse of fuel injection through the fuel injection valve 20, as calculated by the last execution of the main routine of the electronic control computer 50 whose flow chart is shown in FIG. 5. This verifies the previously given formula.

Next, in the AFC=SQF+DT block, the previously calculated value DT is added to this value SQF representing the proper amount of fuel to be injected through the fuel injection valve 20 in the next fuel injection pulse, to give the amount of time that it is proper to command the fuel injection valve 20 to be opened. It should be remembered, as stated above, that in these discussions times of opening of the fuel injection valve 20 and amounts of fuel to be injected therethrough have been spoken of without particular distinction being made between them. This value DT corresponds, as has been explained above, to the dead time of the fuel injection valve 20, i.e. to its time lag after it is opened and before it commences to inject fuel into the intake manifold 11, less its time lag after it is closed and before it ceases to inject fuel into the intake manifold 11. From this AFC=SQF+DT block, the flow of control passes to enter next the OUTPUT FUEL INJECTION PULSE (LENGTH AFC) START COMMAND block.

In this OUTPUT FUEL INJECTION PULSE (LENGTH AFC) START COMMAND block, the value of the proper or actual amount AFC of the time that the fuel injection valve 20 is to be actually commanded to be opened is output by the CPU 51, via the output interface circuit 56, to the previously mentioned flipflop, which is SET by this signal representative of the amount AFC of time that the fuel injection valve 20 is to be actually commanded to be opened, so as to cause its output to be energized, said output of said flipflop being amplified and being supplied to the fuel injection valve 20 so as to open it. The value of the proper amount AFC of time for opening of the fuel injection valve 20 is also supplied at the same time to the previously mentioned down counter which is thereby set to said value AFC. As mentioned before, the down counter counts down from this value AFC according to a clock signal supplied from the clock pulse generator or clock, and, when the value in the down counter reaches zero, then the down counter RESETs the flipflop, so as to cause its output to cease to be energized, and so as thereby to close the fuel injection valve 20 so as to terminate the supply of liquid fuel into the intake manifold 11 of the internal combustion engine 1. By such an arrangement, the duration of the pulse of injected liquid fuel is made to be proportional to the signal value AFC outputted by the CPU 51 to the flipflop and the down counter; however, other possible arrangements could be envisaged, and the details thereof are not directly relevant to the present invention. In any case, functionally, the I/O device comprising, in this embodiment, the flipflop, the down counter, and the amplifier, when it receives an output signal of value equal to AFC the desired fuel injection pulse time from the electronic computer 50, substantially immediately opens the fuel injection valve 20 by proper supply of actuating electrical energy thereto, and keeps said fuel injection valve 20 open until an amount of time corresponding to the value of AFC has elapsed, so that a corresponding amount of fuel (allowing for the aforesaid dead fuel injection time DT) has been supplied through said fuel injection valve 20 into the intake manifold 11 of the internal combustion engine 1 so as to be combusted in the combustion chambers 5 thereof. From this OUTPUT FUEL INJECTION PULSE (LENGTH AFC) START COMMAND block, the flow of control passes to enter next the CALCULATE N block, the function of which will be explained later.

On the other hand, in the YES branch from the FUEL CUT OFF TIME? decision block, since it is decided at this point that fuel cut off is to be performed at this time, and therefore at this point no fuel is to be injected into the intake manifold 11 through the fuel injection valve 20, and it is only necessary to update the value of WF, the amount of fuel present in the film of fuel adhering to the wall surfaces of the intake manifold 11 and the intake ports 6, by subtracting therefrom the value of SOA, the sucked off amount of fuel. Therefore, the flow of control passes to enter next the WF=WF−SOA block.

In this WF=WF−SOA block, thus, the value of WF, the amount of fuel present in the film of fuel adhering to the wall surfaces of the intake manifold 11 and the intake ports 6, is updated by subtracting therefrom the value of SOA the sucked off amount of fuel. Of course in this case, since no fuel has been injected through the fuel injection valve 20, no account need be taken of any newly adhered fuel amount. From this WF=WF−SOA block, the flow of control passes to enter next the CALCULATE N block.

When control has arrived at this CALCULATE N block, the matters of initiating fuel injection, if such fuel injection in fact is proper at this time, and of updating the value of WF, the amount of fuel adhering to the wall surfaces of the intake manifold 11 and the intake ports 6, have been attended to by this interrupt routine, and finally the matter of calculating the new current value of engine revolution speed N, as will now be explained, is attended to. Thus, in this block, the electronic computer 50 calculates the current of newest value of N, by consulting a real time clock to find how much real time has elapsed during the last 120°, for example, of rotation of the crankshaft of the internal combustion engine, for example; although other ways could be considered. Again, the details of this calculation are per se well known in various forms to those skilled in the art, and are not directly relevant to the present invention. After this CALCULATE N block, the flow of control passes to the END of this interrupt routine, so as to return to the current control point of the program which was interrupted by the interrupt which caused the calling of this interrupt routine, which may well be the main routine whose flow chart is given in FIG. 5, or could conceivably be some other routine, such as another interrupt routine, which was being executed by the control of the electronic computer 50, just before this execution was interrupted by the interrupt which caused the starting of this interrupt routine of FIG. 6.

Thus, it will be seen that the amount of fuel which is squirted into the intake manifold 11 in successive pulses of fuel injection through the fuel injection valve 20 is determined by the calculated value of the variable SQF, as explained above. In FIG. *7c* there is shown a time chart, in which fuel injection time or corresponding amount of fuel is shown on the ordinate and time is shown on the abscissa, said abscissa corresponding to and indicating the same times as the abscissas of FIG. *7a* and FIG. *7b*, illustrating the same engine accelerational operational episode as the episode illustrated in FIGS. *7a* and *7b*. In this figure, the dashed line shows the aforesaid variation of the value BF representing the basic desired amount of fuel to be supplied into the combustion chambers 5 of the internal combustion engine 1 by the next pulse of fuel injection through the fuel injection valve 20; the single dotted line shows the aforesaid variation of the value CBF which is the corrected or time smoothed value of the aforesaid value BF representing said basic desired amount of fuel to be supplied; and the solid line shows the variation of the value SQF representing the total or cumulative amount of fuel which is actually to be injected through the fuel injection valve 20 in order to supply an amount of fuel represented by this smoothed value CBF to the combustion chambers 5 of the internal combustion engine 1, taking account of the amount of fuel which adheres to the wall surfaces of the intake manifold 11 and of the intake ports 6 of the engine 1. This figure shows that during steady operation of the internal combustion engine 1 this value SQF representing the actual fuel injection amount is substantially equal to the corrected value CBF of the value BF representing the basic desired amount of fuel to be supplied, but that during acceleration of the internal combustion engine 1 the value SQF representing the total or cumulative amount of fuel which is actually to be injected through the fuel injection valve 20 rises quite significantly above the corrected value CBF of the value BF representing the basic desired amount of fuel to be supplied to the combustion chambers, at a somewhat later time in the engine accelerational operational episode than the above mentioned high spike in the basic value BF of desired fuel to be supplied, in order to allow for increasing adhering amount of fuel on the wall surfaces of the intake manifold and the intake ports of the internal combustion engine, and thus cancelling out the danger of the occurrence of a lean spike in the air/fuel ratio of the air-fuel mixture actually supplied to the combustion chambers 5 of the internal combustion engine 1.

In FIG. 8, the behavior of variation of air/fuel ratio of the air-fuel mixture delivered to the combustion chambers 5 of the internal combustion engine 1 by the fuel injection system described above, which is shown by the solid line, is contrasted with the behavior of variation of air/fuel ratio of the air-fuel mixture delivered to combustion chambers by a prior art type fuel injection system, which is shown by the dashed line. FIG. 8 is a time chart, in which air/fuel ratio of delivered air-fuel mixture is shown on the ordinate, and time is shown on the abscissa. In the engine operational episode illustrated by this time chart, again, first the internal combustion engine 1 is being operated in a steady operational mode at a relatively low engine load level; then subsequently the internal combustion engine 1 is accelerated; and then subsequently the internal combustion engine 1 is operated in a steady operational mode at of course a relatively higher load level.

From this figure it is seen that during steady operation of the internal combustion engine 1 both the air/fuel ratio of the air-fuel mixture delivered by the fuel injection system controlled in the manner described above and the air/fuel ratio of the air-fuel mixture delivered by a prior art type fuel injection system are substantially stoichiometric; but that during acceleration of the internal combustion engine 1, whereas the air/fuel ratio of the air-fuel mixture delivered by a prior art type fuel injection system first deviates substantially from stoichiometric towards the rich side, i.e. undergoes a rich spike, and then deviates substantially from stoichiometric towards the lean side, i.e. undergoes a lean spike, by contrast the air/fuel ratio of the air-fuel mixture delivered by the fuel injection system described above does not deviate substantially from stoichiometric, i.e. does not undergo any substantial rich spike or subsequently any substantial lean spike. Thus it is seen that, according to the present invention, during acceleration of the internal combustion engine 1, even quite sharp acceleration, as well as during steady operation thereof, the internal combustion engine 1 is supplied with an air-fuel mixture of substantially correct or stoichiometric air/fuel ratio, which is very beneficial with regard to giving good drivability of the internal combustion engine 1, as well as with regard to providing good quality for the exhaust emissions of said internal combustion engine 1.

FIG. 9 is a time chart, in which vehicle acceleration is shown on the ordinate and time is shown on the abscissa, said abscissa corresponding to and indicating the same time as the abscissa of FIG. 8. In this figure, the solid line shows the behavior of variation of vehicle acceleration of a vehicle incorporating an internal combustion engine with a fuel injection system controlled according to the preferred embodiment of the engine control method according to the present invention, as contrasted with the behavior of variation of vehicle acceleration of a vehicle incorporating an internal combustion engine with a fuel injection system controlled according to a prior art method of engine control, which is shown by the dashed line, during the same engine sharp acceleration operational episode as the engine operational episode illustrated in FIG. 8. It will be seen from this figure that when the vehicle incorporating an internal combustion engine with a fuel injection system controlled according to the preferred embodiment of the engine control method according to the present invention is sharply accelerated, it undergoes much less fore and aft shock and vibration and variation of acceleration, i.e. jerk, than does a vehicle incorporating an internal combustion engine with a fuel injection system controlled according to a prior art method which is similarly sharply accelerated.

Although the present invention has been shown and described with reference to a preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. It should be understood, however, that the present invention is definitely limited to a so called L-jetronic type of fuel injection system, in which the operational parameters of the internal combustion engine which are measured in order to calculate the basic amount of fuel to be injected are intake air flow amount or rate and engine revolution speed, since the present invention essentially relates to curbing by calculation of the overshooting of the reading of an air flow meter which senses said intake air flow amount. However, although in the shown embodiment the process was performed of cutting off fuel injection in certain engine operational circumstances, this is not essential to the present invention. The most general form of the present invention does not necessitate such a fuel injection cutting off procedure; however, the shown embodiment of the present invention, which is the preferred one, does utilize such a fuel cut off, and therefore the details of the adaptation of the present invention involved in providing a computer program that also performs fuel cut off have been described. The details of a computer program that does not perform such fuel cut off may be easily filled in by one of ordinary skill in the art, based upon the disclosure herein. Therefore it is desired that the scope of the present invention, and of the protection sought to be granted by Letters Patent, should be defined not by any of the perhaps purely fortuitous details of the shown embodiment, or of the drawings, but solely by the scope of the appended claims, which follow.

What is claimed is:

1. In an internal combustion engine comprising an intake manifold, a fuel injection valve fitted to said intake manifold and adapted to be selectively opened so as to inject fuel into said intake manifold by supply of an actuating signal thereto for a time duration corresponding to that of said actuating signal supplied, and an intake air flow meter of a type having a swingable flapper adapted to be swung by intake air flow for angles corresponding to flow rates of intake air, said intake air flow meter generating an intake air flow rate signal representative of intake air flow rate, a method of controlling fuel injection by said fuel injection valve, comprising the repetitive steps of:

(a) sensing revolution of said engine with an engine revolution sensor so as to generate an engine revolution signal representative of revolutionary speed of said engine;

(b) determining at a sequence of instants separated by successive intervals successive values of a first quantity which is proportional to said intake air flow rate signal and inversely proportional to said engine revolution signal;

(c) determine at said sequence of instants a second quantity which is a sum of a value of said first quantity at an immediately preceding instant to a current instant of said sequence and a predetermined fraction of a difference between said current instant value of said first quantity and said value of said first quantity at said immediately preceding instant to said current instant; and (d) generating said actuating signal to be supplied to said fuel injection valve according to said second quantity, each current rate of time duration in which said actuating signal is supplied to said fuel injection valve being substantially proportional to each current value of said second quantity.

2. In an internal combustion engine comprising an intake manifold, a fuel injection valve fitted to said intake manifold and adapted to be selectively opened so as to inject fuel into said intake manifold by supply of an actuating signal thereto for a time duration corresponding to that of said actuating signal supplied, and an intake air flow meter of a type having a swingable flapper adapted to be swung by intake air flow for angles corresponding to flow rates of intake air, said intake air flow meter generating an intake air flow rate electrical signal representative of intake air flow rate, a fuel injection control device, comprising:

(a) an engine revolution sensor for repeatedly responding to revolution of said engine and for producing an engine revolution electrical signal representative of revolutionary speed of said engine;

(b) an electronic computer for receiving supply of said intake air flow rate electrical signal and said engine revolution electrical signal, said electronic computer including means for:

(i) determining at a sequence of instants separated by successive intervals successive values of a first electrical quantity which is proportional to said intake air flow rate electrical signal and inversely proportional to said engine revolution electrical signal; and (ii) determining at said sequence of instants a second electrical quantity which is a sum of a value of said first electrical quantity at an immediately preceding instant to a current instant in said sequence and a predetermined fraction of a difference between said current instant value of said first electrical quantity and said value of said first electrical quantity at said immediately preceding instant to said current instant; and (c) an interface device which converts said second electrical quantity to said actuating signal supplied to said fuel injection valve to cause it to open for a period corresponding to said value of said second electrical quantity to pass therethrough fuel to be injected into said intake manifold.

3. The method of controlling fuel injection according to claim 1, further comprising the repetitive steps of:

(e) determining at said sequence of instants each current amount of fuel caught as adhered onto an inner wall surface of said intake manifold according to each current value of said second quantity, and each current value of fuel thus accumulated on said inner wall surface of said intake manifold; and (f) determining at said sequence of instants each current amount of fuel carried by intake air flow off from fuel accumulated on said inner wall surface of said intake manifold according to each current amount of fuel accumulated on said inner wall surface of said intake manifold;

wherein generation of said actuating signal is modified so that each current rate of time duration in which said actuating signal is supplied to said fuel injection valve is substantially proportional to each current value of said second quantity and is further increased by an amount corresponding to each current amount of fuel caught as adhered onto said inner wall surface of said intake manifold and is further decreased by an amount corresponding to each current amount of fuel carried by intake air flow off from fuel accumulated on said inner wall surface of said intake manifold.

4. A method of controlling fuel injection according to claim 3, further comprising repetitively:

(g) sensing an intake air temperature by an intake air temperature sensor to generate an intake air temperature signal, wherein said second quantity is further modified by said intake air temperature signal.

5. A method of controlling fuel injection according to claim 3, further comprising repetitively:

(g) sensing oxygen content in gases exhausted from said engine by an oxygen sensor to generate an excess air signal, wherein said second quantity is further modified by said excess air signal.

6. A method for controlling fuel injection according to claim 3, further comprising repetitively:

(g) sensing temperature of said engine by an engine temperature sensor to generate an engine temperature signal, wherein said second quantity is further modified by said engine temperature signal.

7. A fuel injection control device according to claim 2, wherein said electronic computer further includes means for determining at said sequence of instants each current amount of fuel caught as adhered onto an inner wall surface of said intake manifold according to each current value of said second electrical quantity and each current value of fuel thus accumulated on the inner wall surface of said intake manifold, for determining at said sequence of instants each current amount of fuel carried by intake air flow off from fuel accumulated on said inner wall surface of said intake manifold according to each current amount of fuel accumulated on said inner wall surface of said intake manifold, and for modifying said second electrical quantity so that said second electrical quantity is increased by an amount corresponding to each current amount of fuel caught as adhered onto said inner wall surface of said intake manifold and is decreased by an amount corresponding to each current amount of fuel carried by intake air flow off from fuel accumulated on said inner wall surface of said intake manifold.

8. A fuel injection control device according to claim 2, further comprising:

(d) an intake air temperature sensor which responds to temperature of engine intake air and generates an intake air temperature electrical signal, wherein said electronic computer further modifies said second electrical quantity by said intake air temperature electrical signal.

9. A fuel injection control device according to claim 2, further comprising:

(d) an oxygen sensor which responds to oxygen content in gases exhausted from the engine and generates an excess air electrical signal, wherein said electronic computer further modifies said second electrical quantity by said excess air electrical signal.

10. A fuel injection control device according to claim 2, further comprising:

(d) an engine temperature sensor which responds to engine temperature and generates an engine temperature signal, wherein said electronic computer further modifies said second electrical quantity by said engine temperature electrical signal.

* * * * *